US009856099B2

(12) United States Patent
Aoyama et al.

(10) Patent No.: US 9,856,099 B2
(45) Date of Patent: Jan. 2, 2018

(54) SHEET FEEDER AND IMAGE FORMING APPARATUS INCORPORATING THE SHEET FEEDER

(71) Applicants: Jumpei Aoyama, Kanagawa (JP); Hajime Nishida, Kanagawa (JP); Manabu Nonaka, Kanagawa (JP); Junichi Sugita, Tokyo (JP); Kenji Ueda, Kanagawa (JP)

(72) Inventors: Jumpei Aoyama, Kanagawa (JP); Hajime Nishida, Kanagawa (JP); Manabu Nonaka, Kanagawa (JP); Junichi Sugita, Tokyo (JP); Kenji Ueda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/151,566

(22) Filed: May 11, 2016

(65) Prior Publication Data

US 2016/0334748 A1 Nov. 17, 2016

(30) Foreign Application Priority Data

| | | |
|---|---|---|
| May 15, 2015 | (JP) | 2015-100321 |
| Sep. 14, 2015 | (JP) | 2015-181028 |
| Nov. 24, 2015 | (JP) | 2015-229154 |
| Mar. 4, 2016 | (JP) | 2016-042633 |

(51) Int. Cl.

| | |
|---|---|
| ***B65H 3/52*** | (2006.01) |
| ***B65H 3/06*** | (2006.01) |
| ***G03G 15/00*** | (2006.01) |

(52) U.S. Cl.
CPC ..... *B65H 3/5223* (2013.01); *B65H 3/06* (2013.01); *G03G 15/6511* (2013.01)

(58) Field of Classification Search
CPC .. B65H 3/5207; B65H 3/5215; B65H 3/5223; B65H 3/5261
USPC ..... 271/121, 124, 125
See application file for complete search history.

(56) References Cited

U.S. PATENT DOCUMENTS

| | | | | |
|---|---|---|---|---|
| 4,083,555 | A * | 4/1978 | Irvine | B65H 3/5207 271/10.13 |
| 2003/0155702 | A1 | 8/2003 | Togashi et al. | |
| 2005/0253323 | A1 | 11/2005 | Fujita et al. | |
| 2006/0170147 | A1* | 8/2006 | Sata | B65H 3/06 271/121 |

(Continued)

FOREIGN PATENT DOCUMENTS

| | | |
|---|---|---|
| JP | H08-188286 | 7/1996 |
| JP | 2001-163472 | 6/2001 |

(Continued)

*Primary Examiner* — David H Bollinger
(74) *Attorney, Agent, or Firm* — Harness, Dickey & Pierce, P.L.C.

(57) ABSTRACT

A sheet feeder, which is included in an image forming apparatus, includes a sheet feeding unit to feed a sheet, a sheet separating unit disposed opposite the sheet feeding unit to separate the sheet together with the sheet feeding unit, a bottom plate on which the sheet is loaded, a pressing unit having a leading end and movably disposed between the bottom plate and the sheet separating unit, and a support to rotatably support the pressing unit such that the leading end of the pressing unit contacts and separates from the sheet feeding unit.

20 Claims, 21 Drawing Sheets

(56) References Cited

U.S. PATENT DOCUMENTS

| | | | | |
|---|---|---|---|---|
| 2009/0315253 | A1* | 12/2009 | Osakabe | B65H 3/5223 271/121 |
| 2011/0198800 | A1* | 8/2011 | Lan | B65H 3/0684 271/114 |
| 2014/0049000 | A1 | 2/2014 | Kimura et al. | |
| 2014/0197593 | A1* | 7/2014 | Machii | B65H 3/5261 271/121 |
| 2014/0210157 | A1 | 7/2014 | Aoyama | |
| 2014/0212195 | A1 | 7/2014 | Aoyama | |
| 2015/0132039 | A1 | 5/2015 | Tobinaga et al. | |
| 2015/0132040 | A1 | 5/2015 | Aoyama et al. | |
| 2015/0210490 | A1* | 7/2015 | Katsura | B65H 3/5215 271/121 |

FOREIGN PATENT DOCUMENTS

| | | |
|---|---|---|
| JP | 2002-338065 | 11/2002 |
| JP | 2003-146462 | 5/2003 |
| JP | 2003-341869 | 12/2003 |
| JP | 2004-137031 | 5/2004 |
| JP | 2008-138816 | 6/2008 |
| JP | 2010-079219 | 4/2010 |
| JP | 2010-180038 | 8/2010 |
| JP | 2010-184804 | 8/2010 |
| JP | 2014-037299 | 2/2014 |

* cited by examiner

SHEET FEEDER AND IMAGE FORMING APPARATUS INCORPORATING THE SHEET FEEDER

CROSS-REFERENCE TO RELATED APPLICATIONS

This patent application is based on and claims priority pursuant to 35 U.S.C. §119(a) to Japanese Patent Application Nos. 2015-100321, filed on May 15, 2015, 2015-181028, filed on Sep. 14, 2015, 2015-229154, filed on Nov. 24, 2015, and 2016-042633, filed on Mar. 4, 2016, in the Japan Patent Office, the entire disclosure of each of which is hereby incorporated by reference herein.

BACKGROUND

Technical Field

This disclosure relates to a sheet feeder and an image forming apparatus incorporating the sheet feeder.

Related Art

Various types of known image forming apparatuses include a sheet feeder having a multi-feed sheet separator. Such a multi-feed sheet separator includes a sheet feed roller that functions as a sheet feed unit, a pickup roller, a sheet separation roller that functions as a sheet separating unit, a brake, a separation roller holder, a pressure spring, and a separator. A sheet that functions as a recording medium has a leading end that bends between the pickup roller and the sheet feed roller due to a reaction force generated by contacting a nip region formed between the sheet feed roller and the sheet separation roller or the separator, which increases a degree of a contact angle with the separator. The increase in the contact angle decreases a shearing force that can be applied by the separator to flip through the multi-feed sheets, and therefore the multi-feed sheet separator cannot separate the sheets. As a result, the multi-feed errors occur frequently. As an example, a configuration having a sheet guide on an opposite side to the separator has been proposed to address this inconvenience.

SUMMARY

At least one aspect of this disclosure provides a sheet feeder including a sheet feeding unit to feed a sheet, a sheet separating unit disposed opposite the sheet feeding unit to separate the sheet together with the sheet feeding unit, a bottom plate on which the sheet is loaded, a pressing unit having a leading end and movably disposed between the bottom plate and the sheet separating unit, and a support to rotatably support the pressing unit such that the leading end of the pressing unit contacts and separates from the sheet feeding unit.

Further, at least one aspect of this disclosure provides an image forming apparatus including an image forming device to form an image on a sheet, and the above-described sheet feeder to convey the sheet toward the image forming device.

DETAILED DESCRIPTION

Figure 1:
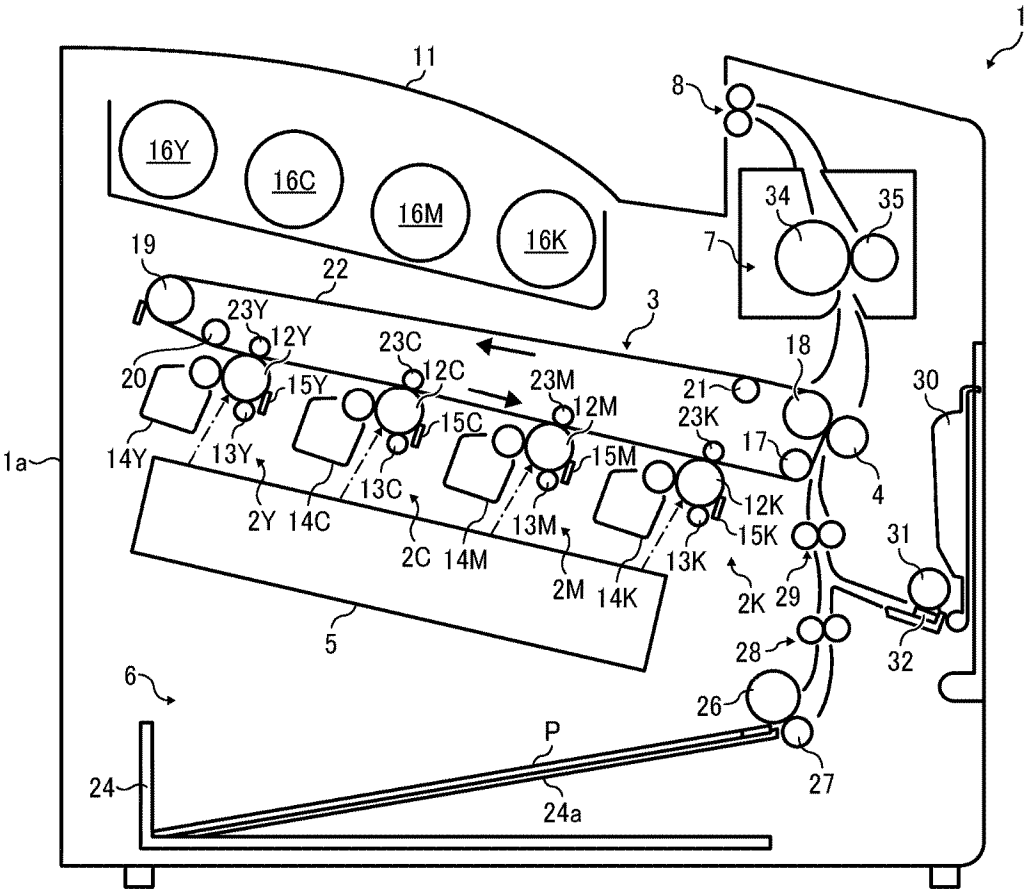
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an entire configuration and functions of an image forming apparatus 1 according to an embodiment of this disclosure.

FIG. 1 is a schematic diagram illustrating the image forming apparatus 1 according to an embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 1 includes an apparatus body 1*a* that includes four image forming units 2Y, 2C, 2M, and 2K, a primary transfer unit 3, a secondary transfer roller 4, an optical writing device 5, a sheet feeding device 6 that functions as a sheet feeder, a fixing device 7, a pair of sheet ejection rollers 8, and an output tray 11.

The image forming units 2Y, 2C, 2M, and 2K functioning as image forming devices are disposed at a substantially center of the apparatus body 1*a*. The image forming units 2Y, 2C, 2M, and 2K correspond to yellow image, cyan image, magenta image, and black image, respectively, and include respective photoconductor drums 12Y, 12C, 12M, and 12K, each of which functions as an image bearer. Further, the image forming units 2Y, 2C, 2M, and 2K include charging rollers 13Y, 13C, 13M, and 13K, developing devices 14Y, 14C, 14M, and 14K, and photoconductor cleaning devices 15Y, 15C, 15M, and 15K, respectively. It is to be noted that the image forming units 2Y, 2C, 2M, and 2K are occasionally referred to as the "image forming unit 2" in a single form without suffixes. An optical writing device 5 emits light to irradiate a surface of the photoconductor drum 12 (i.e., the photoconductor drums 12Y, 12C, 12M, and 12K), so that an electrostatic latent image that corresponds to the image is formed on the surface of the photoconductor drum 12. The electrostatic latent image is developed with toner supplied by a toner bottle 16 (i.e., toner bottles 16Y, 16C, 16M, and 16K) to the developing device 14 (i.e., the developing devices 14Y, 14C, 14M, and 14K).

The primary transfer unit 3 is disposed above the image forming unit 2. The primary transfer unit 3 includes an entrance roller 17, a driving roller 18, an opposed roller 19, a backup roller 20, a support roller 21, and a transfer belt 22. The transfer belt 22 is wound around these rollers. The primary transfer unit 3 further includes primary transfer rollers 23Y, 23C, 23M, and 23K. The primary transfer rollers 23Y, 23C, 23M, and 23K are disposed facing the photoconductor drums 12Y, 12C, 12M, and 12K, respectively, via the transfer belt 22. The single toner images having respective colors of yellow, cyan, magenta, and black formed on the photoconductor drums 12Y, 12C, 12M, and 12K are sequentially overlaid on the surface of the transfer belt 22.

The secondary transfer roller 4 is disposed at a position facing the driving roller 18 via the transfer belt 22. A bias applying unit applies a bias to the secondary transfer roller 4. By so doing, the secondary transfer roller 4 transfers the composite toner image formed on the surface of the transfer belt 22 onto a sheet P that is fed from the sheet feeding device 6.

The optical writing device 5 is disposed below the image forming unit 2. The optical writing device 5 includes a light source, a polygon mirror, various mirrors and lenses and forms an electrostatic latent image corresponding to an image inputted from outside onto the surface of the photoconductor drum 12.

The sheet feeding device 6 is disposed at a lower part of the apparatus body 1*a* and includes a sheet tray 24, a sheet feed roller 26, and a sheet separation roller 27. The sheet tray 24 includes a bottom plate 24*a* on which a sheet P that functions as a recording medium is loaded. The sheet feed roller 26 functions as a sheet feeding unit to feed the sheet from the sheet tray 24. The sheet separation roller 27 functions as a sheet separating unit to separate the sheet P together with the sheet feed roller 26. The sheet feeding device 6 further includes a pair of sheet conveying rollers 28, a pair of registration rollers 29, a bypass tray 30, a secondary bypass sheet feed roller 31, and a friction pad 32. The secondary bypass sheet feed roller 31 feeds the sheet P from the bypass tray 30. The friction pad 32 separates the sheet P together with the secondary bypass sheet feed roller 31.

The sheet tray 24 that is located at the lowest part of the apparatus body 1*a* can be pulled out to the right in FIG. 1 when a cover that is openably supported by the apparatus body 1*a*. The bottom plate 24*a* of the sheet tray 24 is vertically movable. Multiple sheets P can be loaded on the bottom plate 24*a*. The sheet feed roller 26 is disposed above the bottom plate 24*a* to contact with an uppermost sheet P on top of a bundle of sheets loaded on the bottom plate 24*a*. The sheet feed roller 26 is driven by a drive unit to rotate in a counterclockwise direction in FIG. 1. The sheet separation roller 27 has a high friction resistance member such as rubber around a circumferential surface thereof. The circumferential surface of the sheet separation roller 27 is pressed against a circumferential surface of the sheet feed roller 26 by a biasing unit. Details of the biasing unit are described below.

The pair of sheet conveying rollers 28 includes a driving roller and a driven roller, both of which are rotatably supported by the apparatus body 1*a*. The driving device is driven by a driving device to rotate, thereby rotating the driven roller to convey the sheet P. The pair of registration rollers 29 is disposed downstream from the pair of sheet conveying rollers 28 in a sheet conveying direction and includes a driving roller and a driven roller. The driving roller of the pair of registration rollers 29 rotates to convey the sheet P toward a downstream side at a predetermined timing.

The bypass tray 30 is supported by a cover to open and close about a shaft. Sheets are loaded on an upper face of the bypass tray 30 when the bypass tray 30 is open. The secondary bypass sheet feed roller 31 is also support by the cover to open and close about a shaft. The secondary bypass sheet feed roller 31 separates and feeds the sheet P loaded on the bypass tray 30 cooperating together with the friction pad 32. The cover also supports the secondary transfer roller 4 and a pressure roller 35. When the cover is open, a sheet conveying path through which the sheet P passes becomes open.

The fixing device 7 is disposed downstream from the secondary transfer roller 4 in the sheet conveying direction. The fixing device 7 includes a heat roller 34 and a pressure roller 35 and is disposed at the upper part of the apparatus body 1*a*. The heat roller 34 includes a heater therein and is rotatably supported by the apparatus body 1*a*. The heat roller 34 is rotated by a drive unit. The pressure roller 35 that is rotatably supported by the cover. A biasing force applied by a biasing member presses a circumferential surface of the pressure roller 35 against a circumferential surface of the heat roller 34, so that the pressure roller 35 is rotated along with the rotation of the heat roller 34. The toner image formed on the sheet P that passes between the heat roller 34 and the pressure roller 35 is fixed to the sheet P by application of heat and pressure.

The pair of sheet ejection rollers 8 is disposed downstream from the fixing device 7 in the sheet conveying direction. The pair of sheet ejection rollers 8 includes a drive roller driven by a drive roller and a driven roller. As the drive roller of the pair of sheet ejection rollers 8 is rotated by a drive unit, the driven roller is rotated along with the rotation of the drive roller, so that the sheet P is discharged to the outside of the apparatus body 1*a*. After having been discharged by the pair of sheet ejection rollers 8, the sheet P is ejected to and stacked in the output tray 11 that is formed on the upper face of the apparatus body 1*a* as a single unit with the apparatus body 1*a*.

According to the above-described configuration, the sheet P loaded on the bottom plate 24*a* is held between a pad 24*b* and the sheet feed roller 26 for image formation. By so doing, the sheet P is forwarded to a downstream side to be separated one by one between the sheet feed roller 26 and the sheet separation roller 27. Consequently, the sheet P that has been separated and fed from the sheet tray 24 is conveyed by the pair of sheet conveying rollers 28 and the pair of registration rollers 29. Then, a toner image is transferred onto the sheet P by the secondary transfer roller 4. The sheet P having the toner image thereon then passes the fixing device 7. When passing the fixing device 7, the toner image is fixed to the sheet P. Then, the sheet P is guided to the pair of sheet ejection rollers 8 to be discharged to the output tray 11.

In a comparative image forming apparatus that includes a sheet feeding device, a multi-feed error occurs easily when a sheet is additionally inserted in a sheet tray. The multi-feed error is generated because the additional insertion of a sheet reduces a friction force generated between sheets at a position where the additional sheet is inserted. When the friction force generated at the sheet adding position becomes lower than a friction force generated at another position between the other sheets, a few sheets before the added sheet cannot be separated reliably. Consequently, the sheet P is separated from the sheet adding position, resulting in a multi-feed error in a bundle of sheets.

In order to separate sheets to feed the sheets one by one reliably, a constant friction force is applied between sheets and a lower sheet stays at the nip region without being conveyed together with an upper sheet P when the upper sheet P is being fed.

Next, a description is given of a configuration of the sheet feeding device 6 according to Embodiment 1 of this disclosure.

Figure 2:
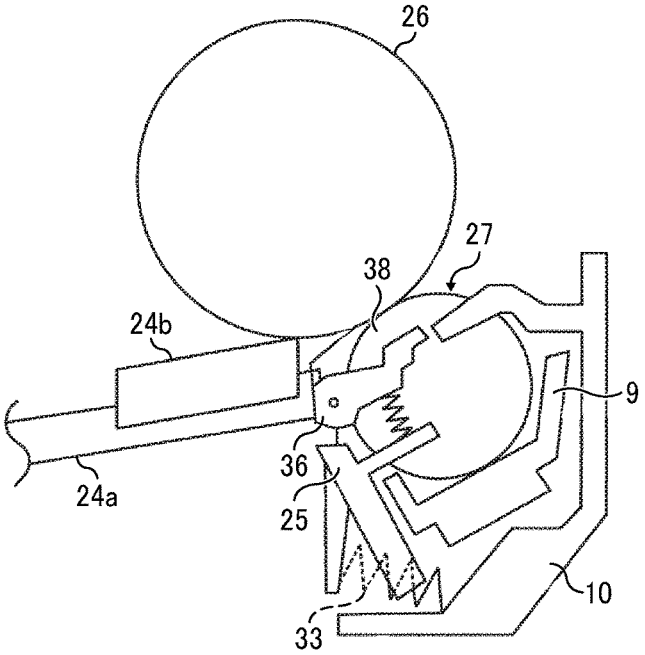
FIG. 2 is a cross sectional view illustrating a sheet feeder according to an embodiment of this disclosure.
Figure 3:
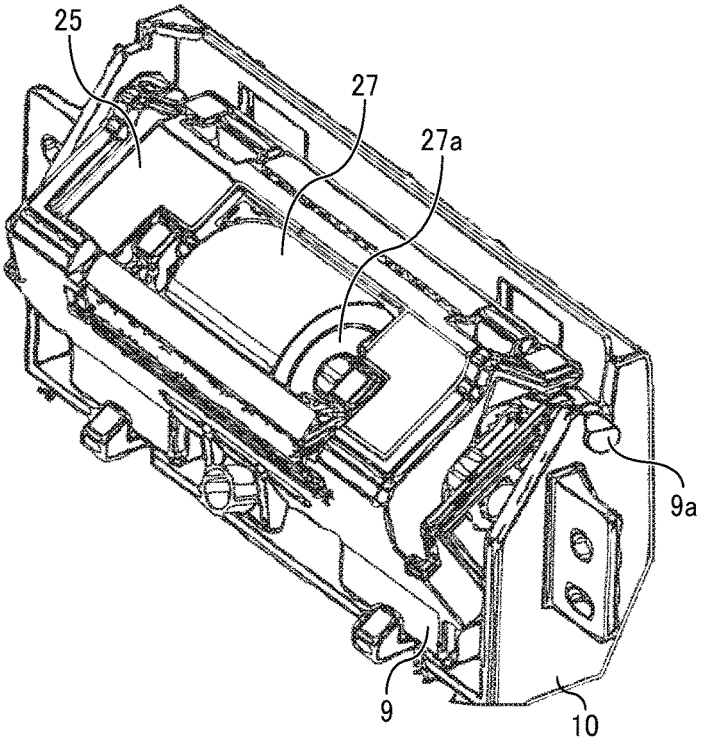
FIG. 3 is a perspective view illustrating the sheet feeder according to an embodiment of this disclosure.
Figure 4:
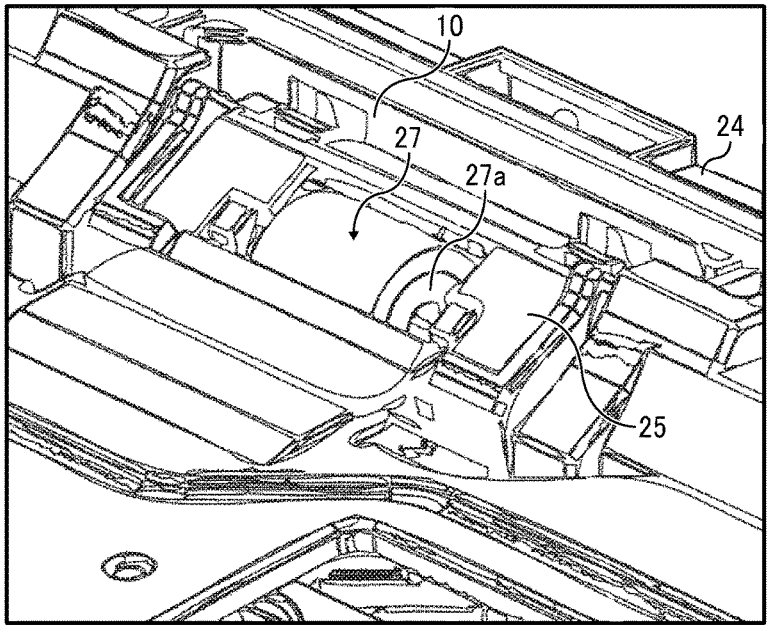
FIG. 4 is an enlarged perspective view illustrating the sheet feeder according to an embodiment of this disclosure.

FIG. 2 is a cross sectional view illustrating the sheet feeding device 6 according to Embodiment 1 of this disclosure. FIG. 3 is a perspective view illustrating the sheet feeding device 6 according to an embodiment of this disclosure. FIG. 4 is an enlarged perspective view illustrating the sheet feeding device 6 according to an embodiment of this disclosure.

In FIG. 2, the pad 24*b* is disposed at a leading end of the bottom plate 24*a*. The pad 24*b* includes a high friction resistance member to prevent a multi-feed error of sheets P. The sheet feed roller 26 is rotatably supported by the apparatus body 1*a* and is driven by a drive unit to rotate in a counterclockwise direction in FIG. 2.

The sheet separation roller 27 is disposed below the sheet feed roller 26 and has a width that is smaller than a width of the sheet feed roller 26. It is to be noted that the width of the sheet separation roller 27 may be greater than the width of the sheet feed roller 26.

As illustrated in FIGS. 2, 3, and 4, the sheet separation roller 27 is rotatably supported by a movable bracket 9. The movable bracket 9 is movably supported at a fulcrum 9*a* by a fixed base 10 that is fixed to the sheet tray 24. A compression spring 33 is disposed between the movable bracket 9 and the fixed base 10. The compression spring 33 applies a biasing force to the movable bracket 9 in a direction in which the sheet separation roller 27 is pressed against the sheet feed roller 26. A torque limiter 27*a* is coaxially disposed in the sheet separation roller 27 and is designed such that the sheet separation roller 27 idles when an excess torque is generated.

Figure 5:
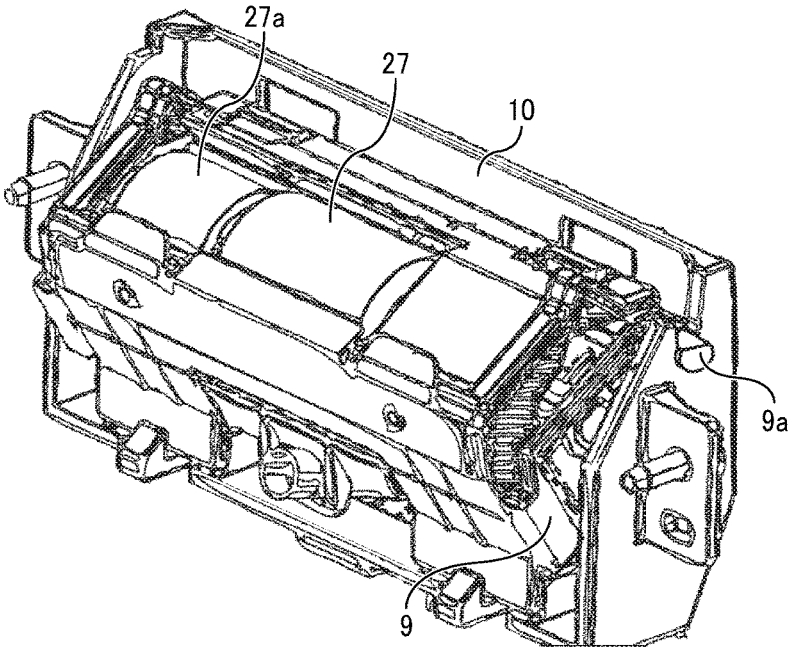
FIG. 5 is a perspective view illustrating a comparative sheet feeder.
Figure 6:
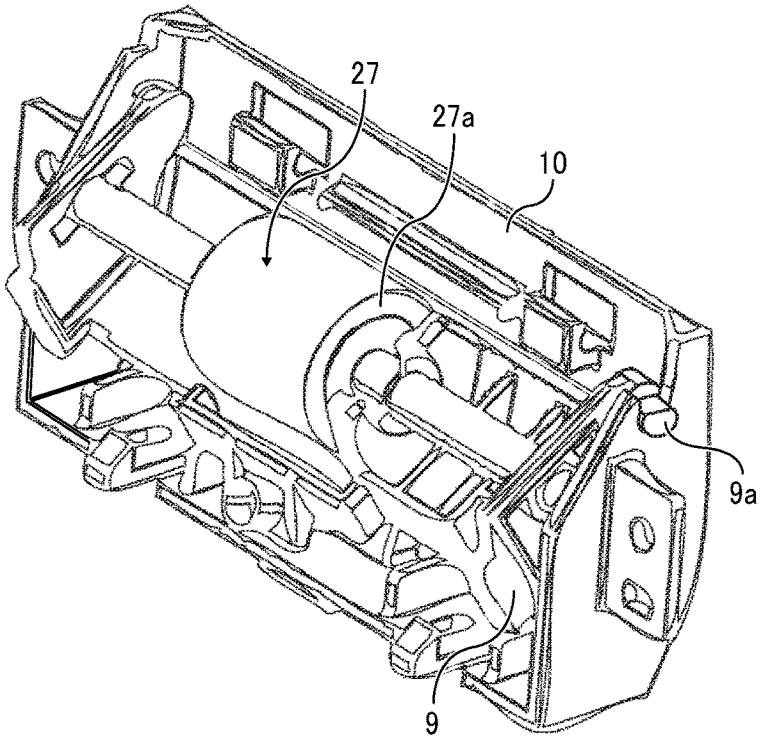
FIG. 6 is a perspective view illustrating an interior of the sheet feeder according to an embodiment of this disclosure.

Now, FIG. 5 is a perspective view illustrating a comparative sheet feeding device. FIG. 6 is a perspective view illustrating an interior of the sheet feeding device 6 according to an embodiment of this disclosure.

As illustrated in FIG. 5, the torque limiter 27*a* is disposed near the sheet separation roller 27 in a comparative sheet feeding device. By contrast, in the sheet feeding device 6 according to an embodiment of this disclosure, the torque limiter 27*a* is disposed in the sheet separation roller 27, and therefore the region that has been occupied by the torque limiter 27*a* in the comparative sheet feeding device can be opened, as illustrated in FIG. 6. Accordingly, the open space made by reducing the length of a support shaft of the sheet separation roller 27 can be used to accommodate other parts or to reduce the size of the image forming apparatus 1.

Figure 7:
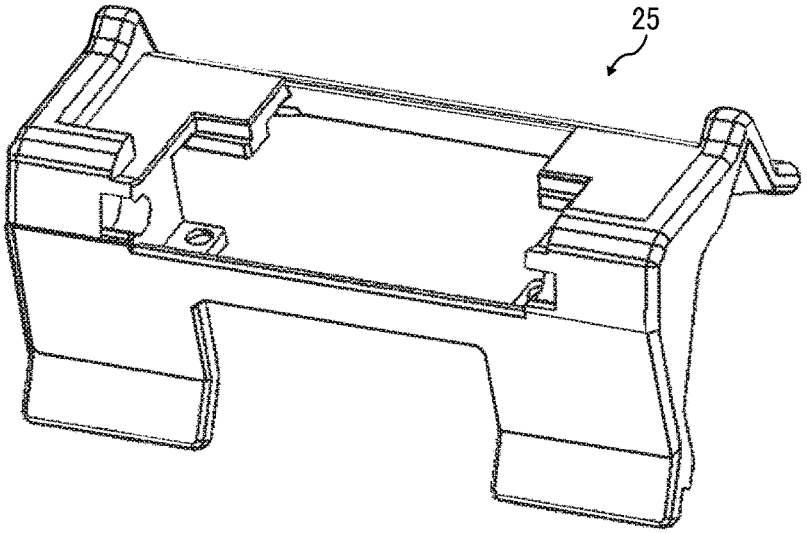
FIG. 7 is a schematic diagram illustrating a fixed guide cover employed to an embodiment of this disclosure.

A fixed guide cover 25 that functions as a support is disposed above the sheet separation roller 27. The sheet P passes over an upper face of the fixed guide cover 25. The fixed guide cover 25 is disposed covering the support shaft of the sheet separation roller 27, so that the upper face of the fixed guide cover 25 can guide conveyance of the sheet P. As illustrated in FIG. 7, the fixed guide cover 25 has an opening through which the circumferential surface of the sheet separation roller 27 is exposed. The fixed guide cover 25 is detachably attached to the fixed base 10 with screws or engaging members.

Figure 8:
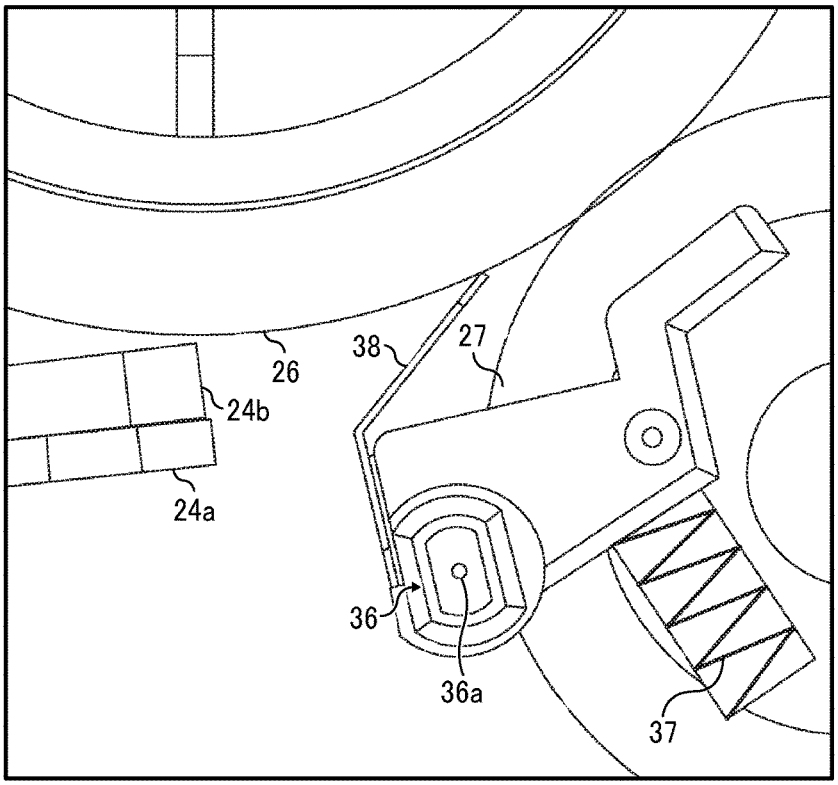
FIG. 8 is an enlarged view illustrating part of a sheet separating unit according to an embodiment of this disclosure.
Figure 9:
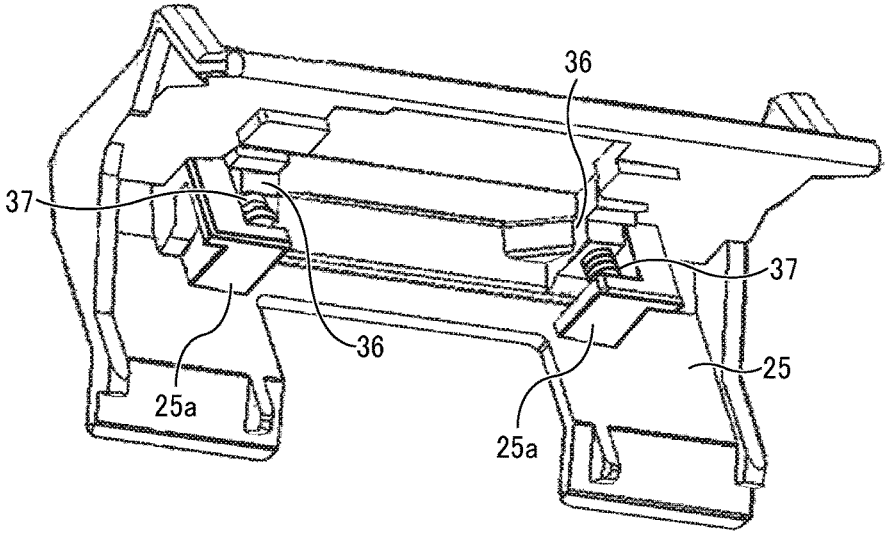
FIG. 9 is a schematic diagram illustrating a fixed guide cover employed to an embodiment of this disclosure.

FIG. 8 is an enlarged view illustrating part of a sheet separating unit according to an embodiment of this disclosure. FIG. 9 is a schematic diagram illustrating the fixed guide cover 25 employed to an embodiment of this disclosure.

As illustrated in FIGS. 8 and 9, a pair of rotary bodies 36 is disposed inside the fixed guide cover 25 and the respective rollers of the pair of rotary bodies 36 are located at respective positions outside support positions of the sheet separation roller 27. Each of the pair of rotary bodies 36 is rotatably supported at a support shaft 36*a* by the fixed guide cover 25. A compression spring 37 that functions as a biasing member is disposed downstream from the support shaft 36*a* in the sheet conveying direction. One end of the compression spring 37 is secured to a projection 25*a* of the fixed guide cover 25. A pressure plate 38 is disposed at an upstream side end of each of the pair of rotary bodies 36 in the sheet conveying direction. The pressure plate 38 functions as a plate-shaped pressing unit and includes a metal material such as stainless steel. The pressure plate 38 is attached by a double tape and glues. The pair of rotary bodies 36 is biased by a biasing force of the compression spring 37 to the counterclockwise direction about the support shaft 36*a* in FIG. 8. According to this configuration, the pressure plate 38 is pressed with a predetermined contact pressure against the circumferential surface of the sheet feed roller 26 at a position downstream from the support shaft 36*a* in the sheet conveying direction.

Figure 10A:
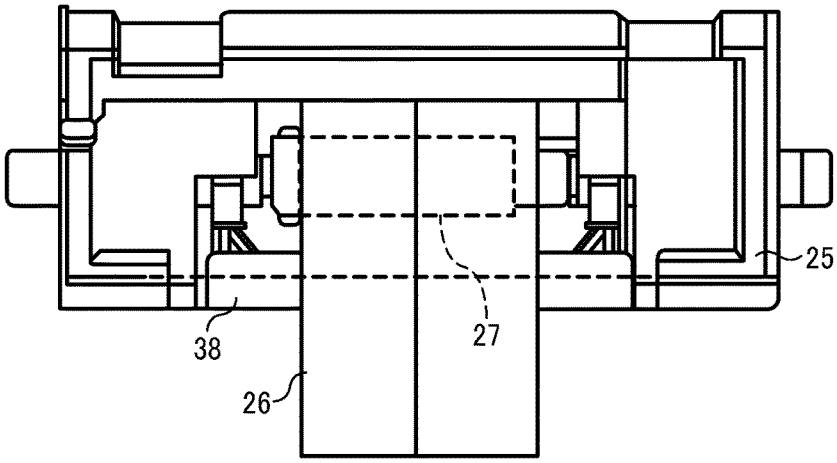
FIG. 10A is a schematic plan view illustrating a sheet feeder according to an embodiment of this disclosure.
Figure 10B:
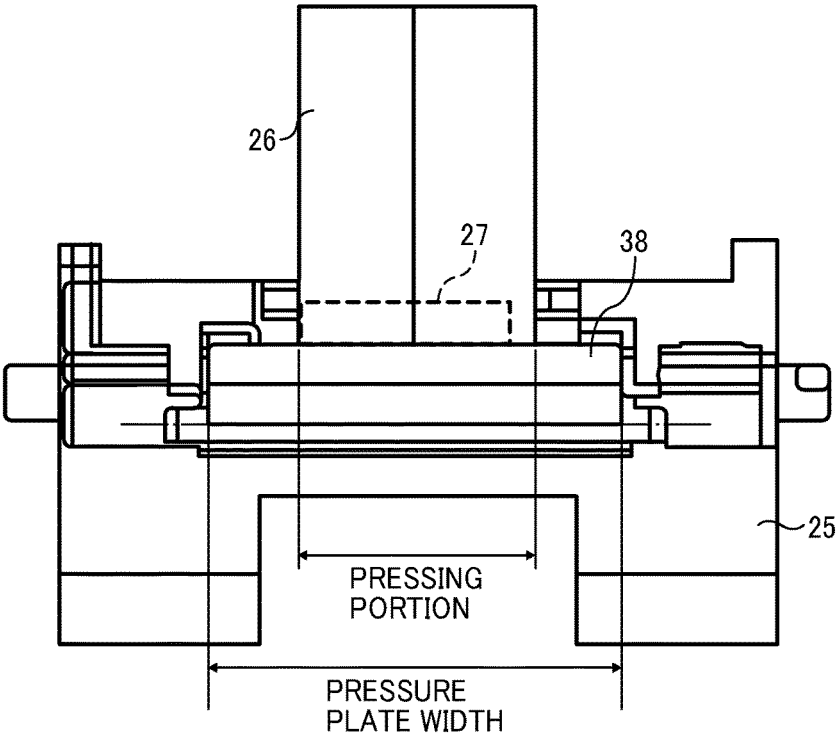
FIG. 10B is a schematic side view illustrating the sheet feeder of FIG. 10A.

FIG. 10A is a schematic plan view illustrating a main part of the sheet feeding device 6 according to an embodiment of this disclosure. FIG. 10B is a schematic side view illustrating the main part of the sheet feeding device 6 of FIG. 10A.

As illustrated in FIGS. 10A and 10B, the pressure plate 38 has a width, in other words, a length in a sheet width direction is greater than the width of the sheet feed roller 26.

Figure 11:
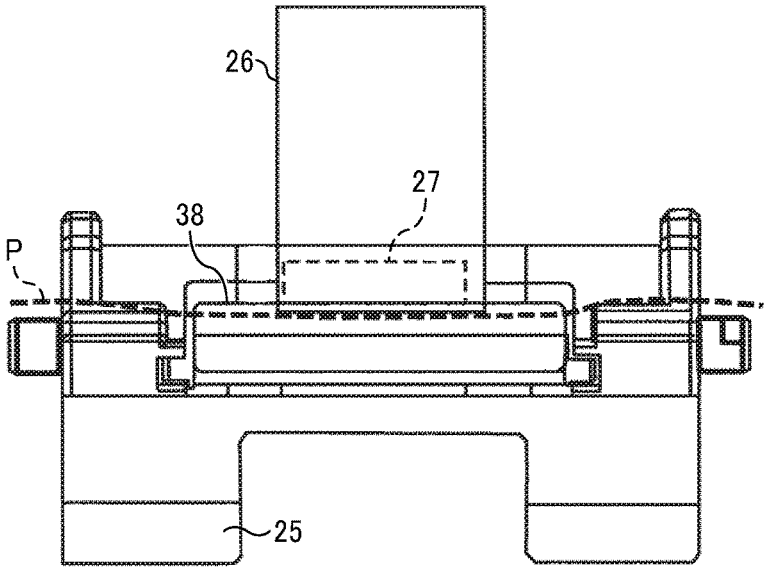
FIG. 11 is a schematic diagram illustrating movement of a sheet in the sheet feeder according to an embodiment of this disclosure.

FIG. 11 is a schematic diagram illustrating movement of the sheet P in the sheet feeding device 6 according to an embodiment of this disclosure.

As illustrated in FIG. 11, the pressure plate 38 can support the sheet P even in an area where the sheet feed roller 26 is not disposed, and therefore can keep the sheet P straight. Consequently, when multiple sheets P enter the nip region formed between the sheet feed roller 26 and the sheet separation roller 27, the sheets remain straight in a stable condition. Accordingly, a friction between any adjacent sheets in the multiple sheets, and therefore can convey the sheet reliably.

As described above in Embodiment 1, the leading end of the pressure plate 38 contacts and separates from the circumferential surface of the sheet feed roller 26. According to this configuration, multiple sheets P come to the nip region between the sheet feed roller 26 and the sheet separation roller 27. At this time, when the multiple sheets P pass through a pressing portion formed by the pressure plate 38, a lower sheet P of the multiple sheets P contacts a sloped face of the pressure plate 38. By the contact with the sloped face of the pressure plate 38, the lower sheet P receives a sheet conveyance load (a resistance), and therefore the lower sheet P does not ride over the pressure plate 38 and the upper sheet P of the multiple sheets P is forwarded to the sheet separation roller 27. Consequently, sheet separation can be performed in two steps, thereby conveying the sheet P without causing a multi-feed error even if any additional sheet is inserted.

Figure 12:
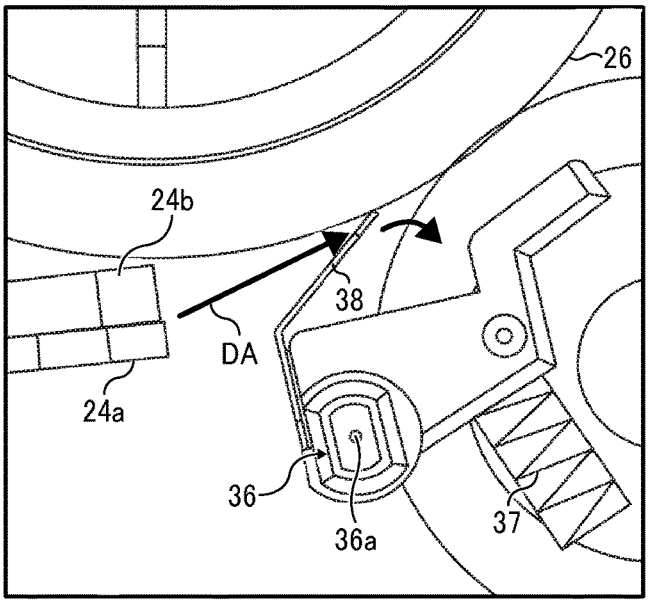
FIG. 12 is an enlarged view illustrating movement of a pressure plate in the sheet feeder according to an embodiment of this disclosure.

Further, FIG. 12 is an enlarged view illustrating movement of the pressure plate 38 in the sheet feeding device 6 according to an embodiment of this disclosure. In Embodiment 1, the support position of each of the pair of rotary bodies 36 supported by the fixed guide cover 25, which is the position of the support shaft 36*a*, is located upstream from the contact position of the pressure plate 38 and the sheet feed roller 26 in the sheet conveying direction. According to this configuration, as illustrated in FIG. 12, even when the multiple sheets P come to enter the contact position between the pressure plate 38 and the sheet feed roller 26, the pressure plate 38 moves to the downstream side in the sheet conveying direction to avoid the multiple sheets, thereby preventing paper jam.

A comparative configuration is known to include a fixed separation plate and another sheet pressing mechanism. However, the comparative configuration does not includes a movable separation plate. Therefore, a thick paper cannot be conveyed or a rubber employed to the sheet separation roller 27, and the durability was unstable.

Figure 13:
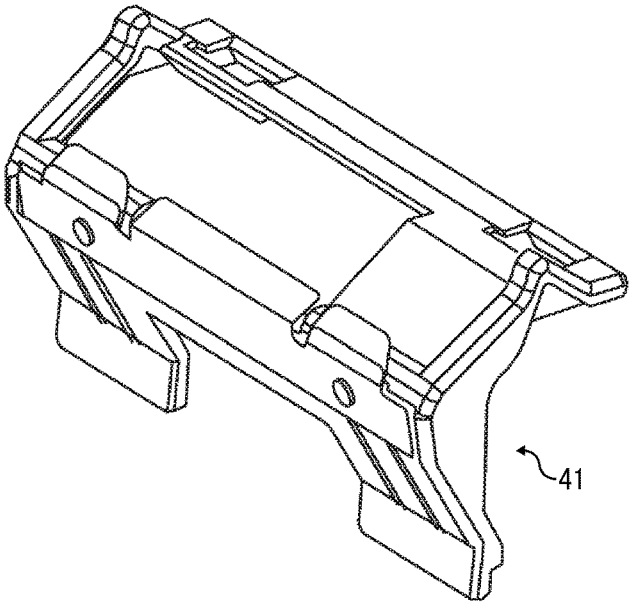
FIG. 13 is a schematic diagram illustrating a comparative fixed guide cover.

FIG. 13 is a schematic diagram illustrating a comparative fixed guide cover. The comparative fixed guide cover 41 that functions as a support including such a separation plate is illustrated in FIG. 13. The fixed guide cover 25 according to this disclosure can achieve the above-described effect by attaching to the fixed base 10 instead of the fixed guide cover 41. Accordingly, the effects of this disclosure can be obtained easily without changing the comparative configuration significantly.

As described above, as illustrated in FIG. 8, Embodiment 1 of this disclosure includes the configuration in which the pressure plate 38 contacts the circumferential surface of the sheet feed roller 26 with a predetermined contact pressure at a position downstream from the support shaft 36*a* in the sheet conveying direction. In other words, Embodiment 1 of this disclosure includes the configuration in which a support position, i.e., a position of the support shaft 36*a* that functions as a rotation fulcrum of the rotary body 36, is located upstream from the separation nip region of the sheet P where a contact position of the pressure plate 38 with the sheet feed roller 26. In this configuration, the pressure plate 38 moves in a direction in which the leading end of the pressure plate 38 bends with respect to a tangent line Q. Therefore, relative to a contact angle θ1 of the pressure plate 38 and the sheet feed roller 26 before the sheet P enters the separation nip region (see FIG. 14), a contact angle θ2 of the pressure plate 38 and the sheet feed roller 26 when the sheet P passes the separation nip region (see FIG. 16) is smaller. Consequently, a restraining force that is received by the sheet P when the sheet P contacts the pressure plate 38 becomes smaller.

Further, in Embodiment 1 illustrated in FIG. 8, the support shaft 36*a* is located downstream in the vertical direction from the tangent line Q that touches the contact position of the pressure plate 38 to the sheet feed roller 26.

Figure 14:
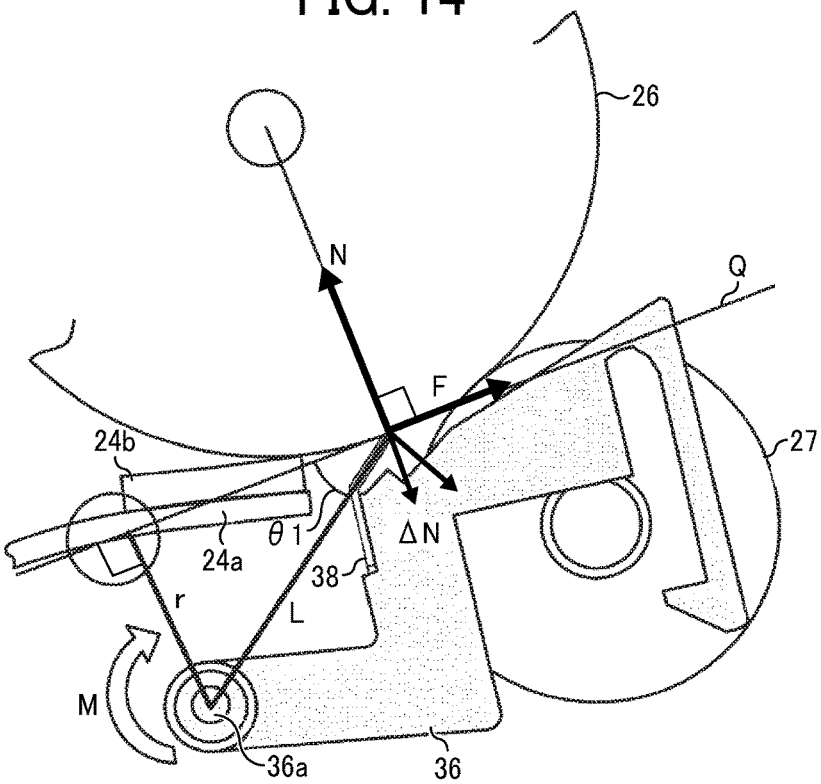
FIG. 14 is a schematic diagram illustrating a positional relation of a rotation shaft and a sheet separation nip region and a positional relation of the rotation shaft and a tangent line at the sheet separation nip region when a sheet is not entered, according to Embodiment 1 of this disclosure.

FIG. 14 is a schematic diagram illustrating a positional relation of the support shaft 36*a* and the sheet separation nip region and a positional relation of the support shaft 36*a* and the tangent line Q at the sheet separation nip region when a sheet P is not entered. In the configuration according to Embodiment 1 of this disclosure as illustrated in FIG. 14, the position of the support shaft 36*a* is located upstream from the sheet separation nip region of the sheet P in the sheet conveying direction and downstream in the vertical direction from the tangent line Q that touches the contact position of the pressure plate 38 to the sheet feed roller 26.

Figure 15:
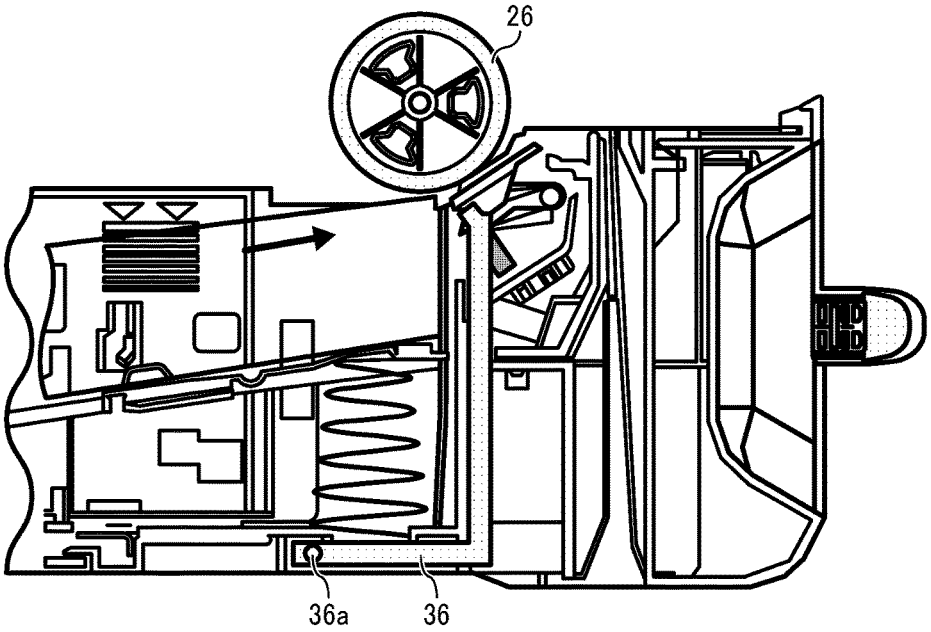
FIG. 15 is a schematic diagram illustrating a layout of the rotary body according to Embodiment 1 of this disclosure.

FIG. 15 is a schematic diagram illustrating an example of another layout of the rotary body 36 according to Embodiment 1 of this disclosure. It is to be noted that the configuration illustrated in FIG. 14 may be arranged to have another layout as illustrated in FIG. 15.

Further, in the configuration in which the position of the support shaft 36*a* is located upstream from the sheet separation nip region of the sheet P in the sheet conveying direction and downstream in the vertical direction from the tangent line Q that touches the contact position of the pressure plate 38 to the sheet feed roller 26, the pressure plate 38 is set to a releasable setting to be releasable with respect to the circumferential surface of the sheet feed roller 26. The releasable setting of the pressure plate 38 to the sheet feed roller 26 is a configuration in which, when a force directing to the sheet conveying direction generated by a friction, for example, with the sheet feed roller 26 or the sheet P is applied to the pressure plate 38, the force causes the pressure plate 38 to turn about the support shaft 36*a*. Accordingly, the leading end of the pressure plate 38 moves in a direction to separate (leave) from the sheet feed roller 26.

Figure 16:
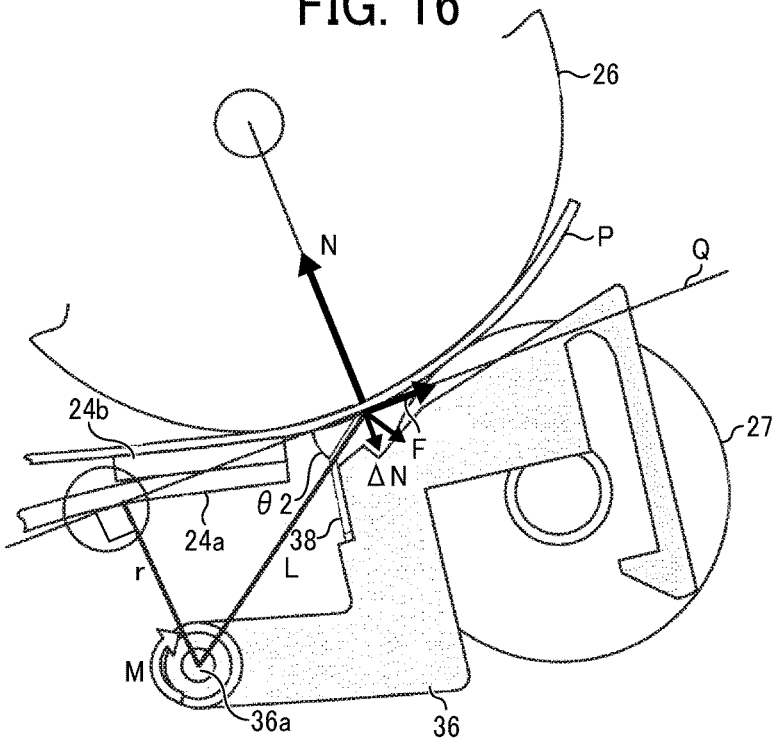
FIG. 16 is a schematic diagram illustrating a positional relation of the rotation shaft and the sheet separation nip region and a positional relation of the rotation shaft and the tangent line at the sheet separation nip region when a sheet is entered, according to Embodiment 1 of this disclosure.

FIG. 16 is a schematic diagram illustrating a positional relation of the support shaft 36*a* and the sheet separation nip region and a positional relation of the rotary shaft and tangent line at the sheet separation nip region when a sheet is entered, according to Embodiment 1 of this disclosure. As illustrated in FIGS. 14 and 16, the pressure plate 38 contacts the circumferential surface of the sheet feed roller 26, a vertical load N applied by the pressure plate 38 acts on the sheet feed roller 26. At this time, the friction force $F=\mu N$ generates a rotational moment $M=rF$. In response to this action, a relief load $\Delta N=(M/L)\cos\theta$ that is applied by the sheet feed roller 26 in an opposite direction to the vertical load N is generated to act on the pressure plate 38, thereby reducing the load on the sheet feed roller 26. Due to the reduction of the load on the sheet feed roller 26, the relief load $\Delta N$ further decreases. Consequently, the load on the sheet feed roller 26 is converged at a further lower value.

Under the above-described conditions, if the sheet P enters to be held between the pressure plate 38 and the sheet feed roller 26, the friction force F decreases and the relief load $\Delta N$ is reduced since the coefficient of friction between the pressure plate 38 and the sheet P is lower than the coefficient of friction between the pressure plate 38 and the sheet feed roller 26. Accordingly, the separation load that acts on the sheet P increases when compared with a configuration in which the pressure plate 38 is directly in contact with the sheet feed roller 26.

It is to be noted that "μ" represents a coefficient of friction, "r" represents a length of a perpendicular line from the center of the support shaft 36*a* to the tangent line Q, and "L" represents a distance from the center of the support shaft 36*a* to a contact position of the pressure plate 38 with the sheet feed roller 26. The values of "μ", "r", and "L" are set to establish the relation of $N>\Delta N$, so as to converge the load on the sheet feed roller 26.

According to Embodiment 1 described above, the position of the support shaft 36*a* that is a rotation fulcrum of the rotary body 36 is disposed upstream in the sheet conveying direction from the sheet separation nip region of the sheet P that is a contact position of the pressure plate 38 with the sheet feed roller 26. Therefore, when the sheet P enters the sheet separation nip region, the rotary body 36 rotates in a direction toward which an angle of the pressure plate 38 bends. Consequently, the probability of no feed of sheets can be reduced when a sheet with high rigidity such as a thick paper is used.

Further, in the configuration, the pressure plate 38 contacts to be releasable with respect to the circumferential surface of the sheet feed roller 26, and therefore the rotary body 36 rotates in a direction to increase the load when the sheet P enters. Accordingly, the separation load increases from the second and subsequent sheets P, and therefore the probability of occurrence of paper jam can be reduced when feeding the sheets P sequentially.

Figure 17:
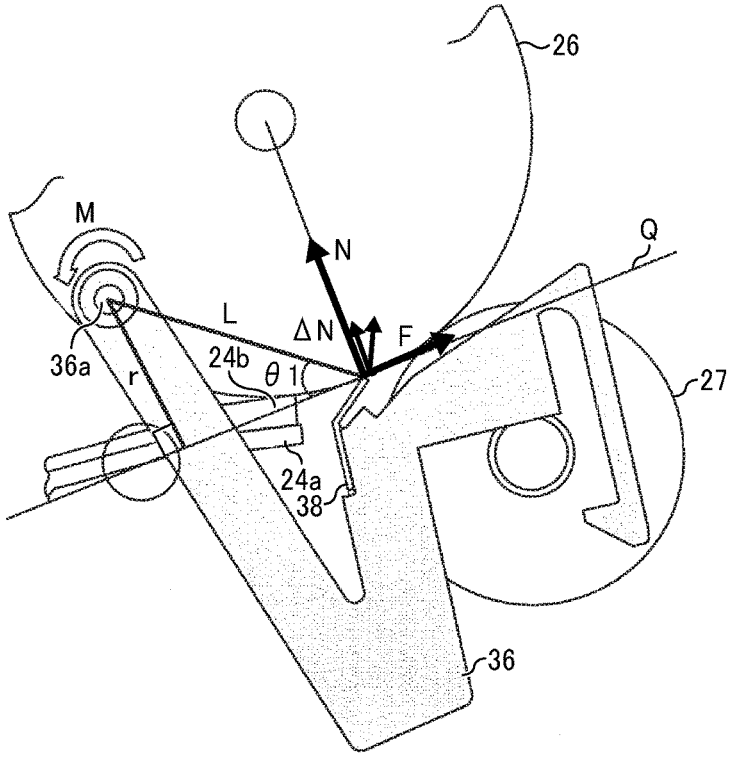
FIG. 17 is a schematic diagram illustrating a positional relation of the rotation shaft and the sheet separation nip region and a positional relation of the rotation shaft and the tangent line at the sheet separation nip region when a sheet is not entered, according to Embodiment 2 of this disclosure.
Figure 18:
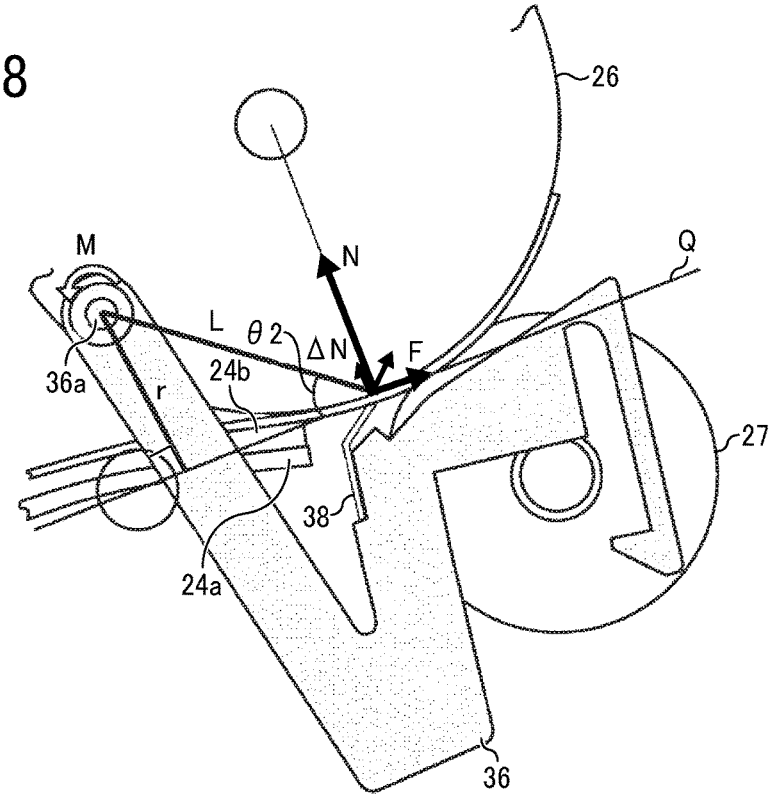
FIG. 18 is a schematic diagram illustrating a positional relation of the rotation shaft and the sheet separation nip region and a positional relation of the rotation shaft and the tangent line at the sheet separation nip region when a sheet is entered, according to Embodiment 2 of this disclosure.

FIGS. 17 and 18 illustrate configurations of the sheet feeding device 6 according to Embodiment 2 of this disclosure. Specifically, FIG. 17 is a schematic diagram illustrating a positional relation of the support shaft 36*a* and the sheet separation nip region and a positional relation of the rotary shaft and the tangent line Q at the sheet separation nip region when a sheet is not entered, according to Embodiment 2 of this disclosure. FIG. 18 is a schematic diagram illustrating a positional relation of the support shaft 36*a* and the sheet separation nip region and a positional relation of the support shaft 36*a* and the tangent line Q at the sheet separation nip region when the sheet is entered, according to Embodiment 2 of this disclosure.

In Embodiment 2, the position of the support shaft 36*a* that is a rotation fulcrum of the rotary body 36 is disposed upstream in the sheet conveying direction from the sheet separation nip region of the sheet P that is a contact position of the pressure plate 38 with the sheet feed roller 26 and, at the same time, the position of the support shaft 36*a* is upstream in the vertical direction from the tangent line Q that touches the contact position of the pressure plate 38 to the sheet feed roller 26. That is, the configuration of the sheet feeding device 6 in Embodiment 2 is basically identical to the configuration of the sheet feeding device 6 in Embodiment 1. Except that the position of the support shaft 36*a* is located upstream from the tangent line Q in the vertical direction in Embodiment 2 while the position of the support shaft 36*a* is located downstream from the tangent line Q in the vertical direction in Embodiment 1.

As described above, when the position of the support shaft 36*a* is upstream from the sheet separation nip region in the sheet conveying direction and upstream from the tangent line Q in the vertical direction, the pressure plate 38 is set to a biting-in setting with respect to the surface of the sheet feed roller 26. The biting-in setting of the pressure plate 38 to the sheet feed roller 26 or the sheet P is a configuration in which, when a force directing to the sheet conveying direction generated by a friction, for example, with the sheet feed roller 26 or the sheet P is applied to the pressure plate 38, the force causes the pressure plate 38 to turn about the sheet shaft 36*a*. Accordingly, the leading end of the pressure plate 38 moves in a direction to approach (bite in) the sheet feed roller 26.

Similar to the configuration according to Embodiment 1 illustrated in FIGS. 14 and 16, in the configuration according to Embodiment 2 illustrated in FIGS. 17 and 18, the pressure plate 38 contacts the circumferential surface of the sheet feed roller 26, the vertical load N applied by the pressure plate 38 acts on the sheet feed roller 26. At this time, the friction force $F=\mu N$ generates the rotational moment $M=rF$. In response to this action, a bite-in load $\Delta N=(M/L)\cos\theta$ that is applied by the pressure plate 38 in a same direction as the vertical load N is generated to act on the sheet feed roller 26, thereby increasing the load on the sheet feed roller 26. Due to the increase of the load on the sheet feed roller 26, the bite-in load $\Delta N$ further increases. Consequently, the load on the sheet feed roller 26 is converged at a further higher value.

Under the above-described conditions, if the sheet P enters to be held between the pressure plate 38 and the sheet feed roller 26, the friction force F is reduced and the bite-in load ΔN is lowered since the coefficient of friction between the pressure plate 38 and the sheet P is lower than the coefficient of friction between the pressure plate 38 and the sheet feed roller 26. Accordingly, the separation load that acts on the sheet P decreases when compared with the configuration in which the pressure plate 38 is directly in contact with the sheet feed roller 26. It is to be noted that "μ" represents a coefficient of friction, "r" represents a length of a perpendicular line from the center of the support shaft 36*a* to the tangent line Q, and "L" represents a distance from the center of the support shaft 36*a* to a contact position of the pressure plate 38 with the sheet feed roller 26. The values of "μ", "r", and "L" are set to establish the relation of N>ΔN, so as to converge the load on the sheet feed roller 26.

According to Embodiment 2 described above, the position of the support shaft 36*a* that is the rotation fulcrum of the rotary body 36 is disposed upstream in the sheet conveying direction from the sheet separation nip region of the sheet P that is the contact position of the pressure plate 38 with the sheet feed roller 26. Therefore, when the sheet P enters the sheet separation nip region, the rotary body 36 rotates in the direction toward which the angle of the pressure plate 38 inclines to bend the pressure plate 38. Consequently, the probability of no feed of sheets can be reduced when a sheet with high rigidity such as a thick paper is used.

Further, in the configuration, the pressure plate 38 contacts in a state in which the pressure plate 38 can bite in the circumferential surface of the sheet feed roller 26, and therefore the rotary body 36 rotates in a direction to reduce the load when the sheet P enters. Accordingly, the separation load on the first sheet P is high, and therefore the probability of occurrence of paper jam can be reduced when the multiple sheets P enters the sheet separation nip region.

Figure 19:
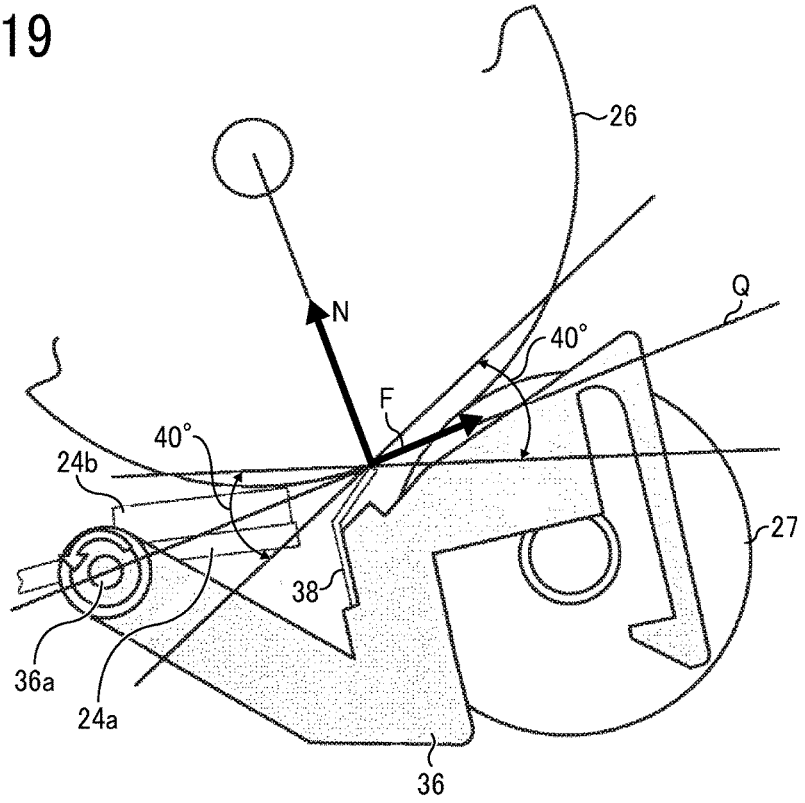
FIG. 19 is a schematic diagram illustrating a positional relation of the rotation shaft and the sheet separation nip region and a positional relation of the rotation shaft and the tangent line at the sheet separation nip region when a sheet is not entered, according to Embodiment 3 of this disclosure.

FIG. 19 illustrates a configuration of the sheet feeding device 6 according to Embodiment 3 of this disclosure. Specifically, FIG. 19 is a schematic diagram illustrating a positional relation of the support shaft 36*a* and the sheet separation nip region and a positional relation of the support shaft 36*a* and the tangent line Q at the sheet separation nip region when the sheet is not entered, according to Embodiment 3 of this disclosure.

In Embodiment 3, the position of the support shaft 36*a* that is the rotation fulcrum of the rotary body 36 is disposed upstream in the sheet conveying direction from the sheet separation nip region of the sheet P that is the contact position of the pressure plate 38 with the sheet feed roller 26 and is disposed in the vicinity in the vertical direction of the tangent line Q that touches the contact position of the pressure plate 38 to the sheet feed roller 26. That is, the configuration of the sheet feeding device 6 in Embodiment 3 is basically identical to the configuration of the sheet feeding device 6 in Embodiment 1. Except that the position of the support shaft 36*a* is located in the vicinity of the tangent line Q in the vertical direction in Embodiment 3 while the position of the support shaft 36*a* is located downstream from the tangent line Q in the vertical direction in Embodiment 1.

It is to be noted that an area in the vicinity of the tangent line Q in the vertical direction in Embodiment 3 corresponds to a range within an angle of ±20 degrees (in other words, in a range within an angle of 40 degrees) across the tangent line Q. The component of a vertical load of the adjacent angle to the tangent line is a ±cos component, and cos(±20 degrees) equals 0.9396. Accordingly, the range within an angle of ±20 degrees across the tangent line Q is set such that the load difference falls within a range of substantially 6 percent (%).

According to Embodiment 3 described above, since the support shaft 36*a* that is the rotation fulcrum of the pressure plate 38 is located in the vicinity of the tangent line Q in the vertical direction in the sheet separation nip region, the pressure plate 38 is not set to the releasable setting (Embodiment 1) or the biting-in setting (Embodiment 3) with respect to the circumferential surface of the sheet feed roller 26. Therefore, a difference between a pressing load applied when the pressure plate 38 is directly in contact with the sheet feed roller 26 and a pressing load applied when the pressure plate 38 is directly in contact with the sheet P is small, and therefore the pressing load of the pressure plate 38 can obtain a constant pressing load with respect to the sheet feed roller 26.

According to Embodiment 3 described above, the position of the support shaft 36*a* that is the rotation fulcrum of the rotary body 36 is disposed upstream in the sheet conveying direction from the sheet separation nip region of the sheet P that is the contact position of the pressure plate 38 with the sheet feed roller 26. Therefore, when the sheet P enters the sheet separation nip region, the rotary body 36 rotates in the direction toward which the angle of the pressure plate 38 inclines to bend the pressure plate 38. Consequently, the probability of no feed of sheets can be reduced when a sheet with high rigidity such as a thick paper is used.

According to position described above, since the position of the support shaft 36*a* is located in the vicinity in the vertical direction of the tangent line Q that touches the contact position of the pressure plate 38 to the sheet feed roller 26, the pressure plate 38 is not set to the releasable setting or the biting-in setting with respect to the sheet feed roller 26. Therefore, the pressing load of the pressure plate 38 with respect to the sheet P becomes stable, and therefore it is easy to achieve the set pressing load. Accordingly, the operability of the image forming apparatus 1 can be enhanced and the probability of occurrence of paper jam can be reduced.

Figure 20:
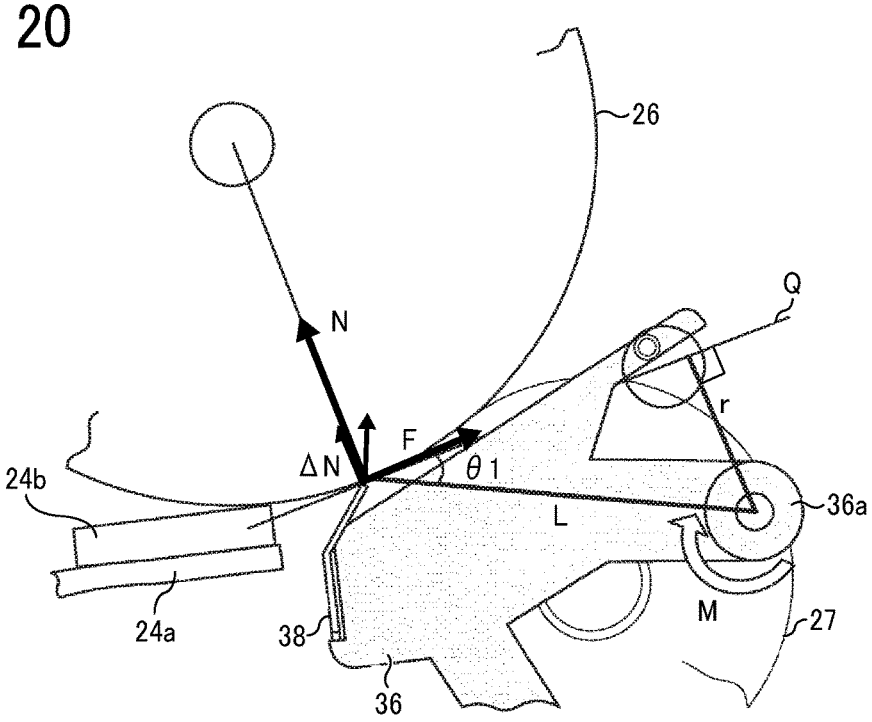
FIG. 20 is a schematic diagram illustrating a positional relation of the rotation shaft and the sheet separation nip region and a positional relation of the rotation shaft and the tangent line at the sheet separation nip region when a sheet is not entered, according to Embodiment 4 of this disclosure.
Figure 21:
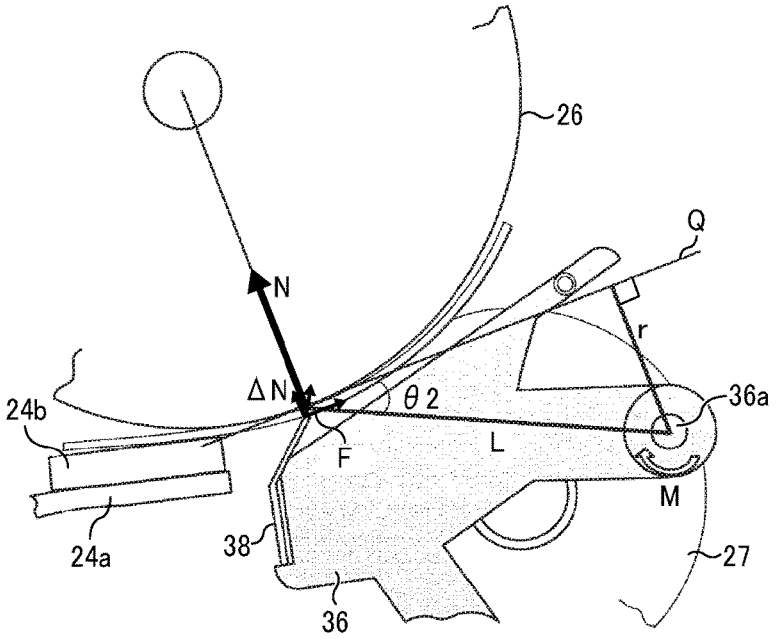
FIG. 21 is a schematic diagram illustrating a positional relation of the rotation shaft and the sheet separation nip region and a positional relation of the rotation shaft and the tangent line at the sheet separation nip region when a sheet is entered, according to Embodiment 4 of this disclosure.

FIGS. 20 and 21 illustrate configurations of the sheet feeding device 6 according to Embodiment 4 of this disclosure. Specifically, FIG. 20 is a schematic diagram illustrating a positional relation of the support shaft 36*a* and the sheet separation nip region and a positional relation of the rotary shaft and the tangent line Q at the sheet separation nip region when a sheet is not entered, according to Embodiment 4 of this disclosure. FIG. 21 is a schematic diagram illustrating a positional relation of the support shaft 36*a* and the sheet separation nip region and a positional relation of the support shaft 36*a* and the tangent line Q at the sheet separation nip region when the sheet is entered, according to Embodiment 4 of this disclosure.

In Embodiment 4, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26 and, at the same time, is downstream in the vertical direction from the tangent line Q that touches the contact position of the pressure plate 38 to the sheet feed roller 26. That is, the configuration of the sheet feeding device 6 in Embodiment 4 is basically identical to the configuration of the sheet feeding device 6 in Embodiment 1. Except that the position of the support shaft 36*a* is located downstream from the sheet separation nip region in the sheet conveying direction in Embodiment 4 while the position of the support shaft 36*a* is located downstream from the tangent line Q in the vertical direction in Embodiment 1.

As described above, the position of the support shaft 36*a* is located downstream from the sheet separation nip region in the sheet conveying direction and downstream in the vertical direction from the tangent line Q. In this configuration of Embodiment 4, the pressure plate 38 is set to the biting-in setting with respect to the circumferential surface of the sheet feed roller 26.

As illustrated in FIGS. 20 and 21, Embodiment 4 of this disclosure includes the configuration in which the pressure plate 38 contacts the circumferential surface of the sheet feed roller 26 with a predetermined contact pressure at a position upstream from the support shaft 36*a* in the sheet conveying direction. In other words, Embodiment 4 of this disclosure includes the configuration in which the support position, i.e., the position of the support shaft 36*a* that is the rotation fulcrum of the rotary body 36, is located downstream from the separation nip region of the sheet P where the contact position of the pressure plate 38 with the sheet feed roller 26. In this configuration, the pressure plate 38 moves in a direction in which the leading end of the pressure plate 38 rises with respect to the tangent line Q. Therefore, relative to a contact angle θ1 of the pressure plate 38 and the sheet feed roller 26 before the sheet P enters the separation nip region (see FIG. 20), a contact angle θ2 of the pressure plate 38 and the sheet feed roller 26 when the sheet P passes the separation nip region (see FIG. 21) is greater. Consequently, a restraining force that is received by the sheet P when the sheet P contacts the pressure plate 38 becomes greater.

Similar to Embodiment 2, Embodiment 4 has a configuration in which the pressure plate 38 is set to be the biting-in setting with respect to the circumferential surface of the sheet feed roller 26. Therefore, as illustrated in FIGS. 20 and 21, the pressure plate 38 contacts the circumferential surface of the sheet feed roller 26, the vertical load N applied by the pressure plate 38 acts on the sheet feed roller 26. At this time, the load to the sheet feed roller 26 is converged to a further higher value.

Under the above-described conditions, if the sheet P enters to be held between the pressure plate 38 and the sheet feed roller 26, the separation load that acts on the sheet P decreases when compared with the configuration in which the pressure plate 38 is directly in contact with the sheet feed roller 26. At this time, same as Embodiment 2, the values of "μ", "r", and "L" are set to establish the relation of $N>\Delta N$, so as to converge the load on the sheet feed roller 26.

According to Embodiment 4 described above, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26. Therefore, when the sheet P enters the sheet separation nip region, the rotary body 36 rotates in the direction toward which the angle of the pressure plate 38 inclines to rise the pressure plate 38. Consequently, the multiple sheets P are prevented from being fed to the sheet separation nip region in a bundle of sheets, thereby reducing the probability of occurrence of multi-feed errors.

Further, in the configuration, the pressure plate 38 contacts the sheet feed roller 26 in a state in which the pressure plate 38 can bite in the circumferential surface of the sheet feed roller 26, and therefore the rotary body 36 rotates in the direction to reduce the load when the sheet P enters. Accordingly, the separation load on the first sheet P is high, and therefore the probability of occurrence of paper jam can be reduced when the multiple sheets P enter the sheet separation nip region.

Figure 22:
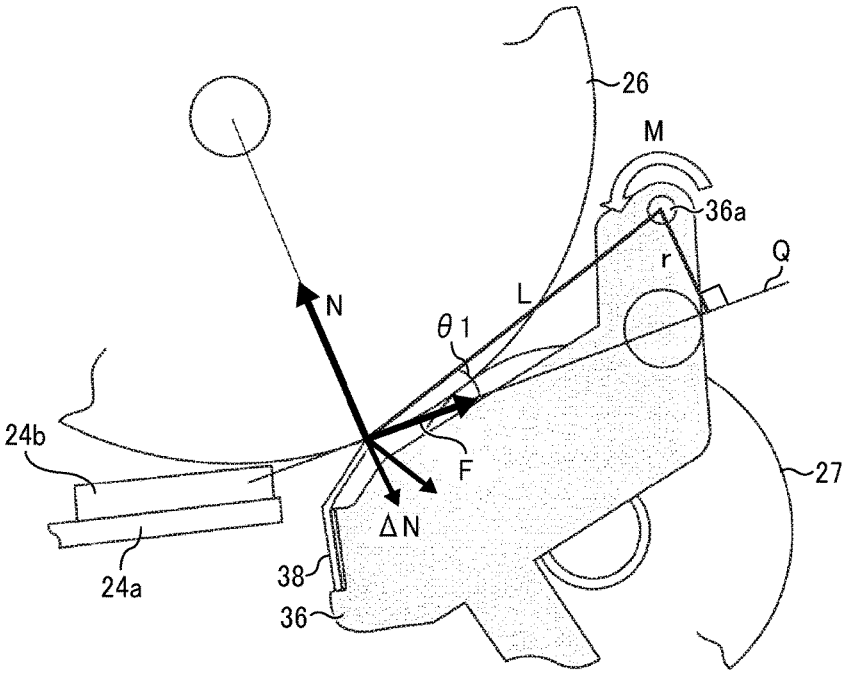
FIG. 22 is a schematic diagram illustrating a positional relation of the rotation shaft and the sheet separation nip region and a positional relation of the rotation shaft and the tangent line at the sheet separation nip region when a sheet is not entered, according to Embodiment 5 of this disclosure.
Figure 23:
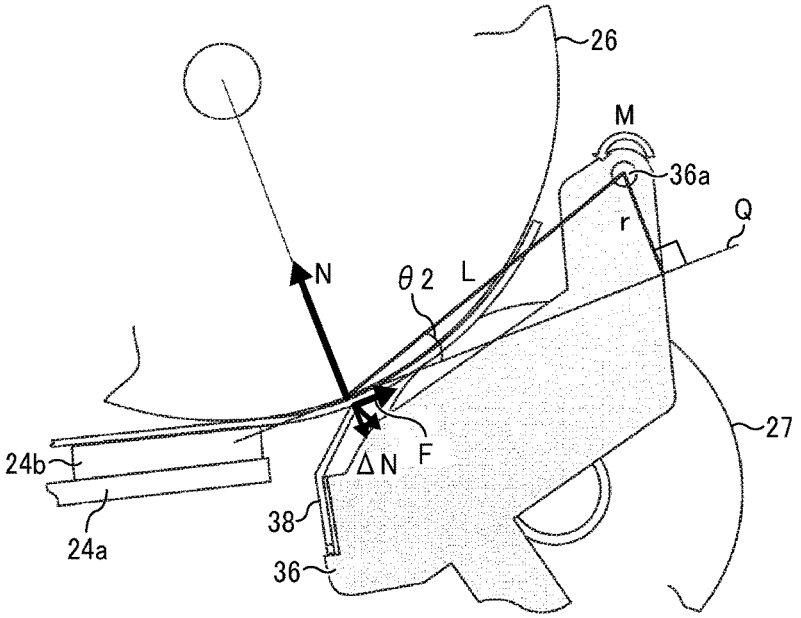
FIG. 23 is a schematic diagram illustrating a positional relation of the rotation shaft and the sheet separation nip region and a positional relation of the rotation shaft and the tangent line at the sheet separation nip region when a sheet is entered, according to Embodiment 5 of this disclosure.

FIGS. 22 and 23 illustrate configurations of the sheet feeding device 6 according to Embodiment 5 of this disclosure. Specifically, FIG. 22 is a schematic diagram illustrating a positional relation of the support shaft 36*a* and the sheet separation nip region and a positional relation of the support shaft 36*a* and the tangent line Q at the sheet separation nip region when a sheet is not entered, according to Embodiment 5 of this disclosure. FIG. 23 is a schematic diagram illustrating a positional relation of the support shaft 36*a* and the sheet separation nip region and a positional relation of the support shaft 36*a* and the tangent line Q at the sheet separation nip region when the sheet is entered, according to Embodiment 5 of this disclosure.

In Embodiment 5, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26 and, at the same time, is upstream in the vertical direction from the tangent line Q that touches the contact position of the pressure plate 38 to the sheet feed roller 26. That is, the configuration of the sheet feeding device 6 in Embodiment 5 is basically identical to the configuration of the sheet feeding device 6 in Embodiment 1. Except that the position of the support shaft 36*a* is located downstream from the sheet separation nip region in the sheet conveying direction and upstream from the tangent line Q in the vertical direction in Embodiment 5 is different from Embodiment 1.

As described above, the position of the support shaft 36*a* is located downstream from the sheet separation nip region in the sheet conveying direction and upstream in the vertical direction from the tangent line Q. In this configuration of Embodiment 5, the pressure plate 38 is set to the releasable setting with respect to the circumferential surface of the sheet feed roller 26.

Similar to Embodiment 1, Embodiment 5 has a configuration in which the pressure plate 38 is set to be the releasable setting with respect to the circumferential surface of the sheet feed roller 26. Therefore, as illustrated in FIGS. 22 and 23, the pressure plate 38 contacts the circumferential surface of the sheet feed roller 26, the vertical load N applied by the pressure plate 38 acts on the sheet feed roller 26. At this time, the load to the sheet feed roller 26 is converged to a further lower value.

Under the above-described conditions, if the sheet P enters to be held between the pressure plate 38 and the sheet feed roller 26, the separation load that acts on the sheet P increases when compared with the configuration in which the pressure plate 38 is directly in contact with the sheet feed roller 26.

At this time, same as Embodiment 1, the values of "μ", "r", and "L" are set to establish the relation of $N>\Delta N$, so as to converge the load on the sheet feed roller 26.

According to Embodiment 5 described above, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26. Therefore, when the sheet P enters the sheet separation nip region, the rotary body 36 rotates in the direction toward which the angle of the pressure plate 38 inclines to rise the pressure plate 38. Consequently, the multiple sheets P are prevented from being fed to the sheet separation nip region in a bundle of sheets, thereby reducing the probability of occurrence of multi-feed errors.

Further, in the configuration, the pressure plate 38 contacts to be releasable with respect to the circumferential surface of the sheet feed roller 26, and therefore the rotary body 36 rotates in the direction to increase the load when the sheet P enters. Accordingly, the separation load increases from the second and subsequent sheets P, and therefore the probability of occurrence of paper jam can be reduced when feeding the sheets P sequentially.

Figure 24:
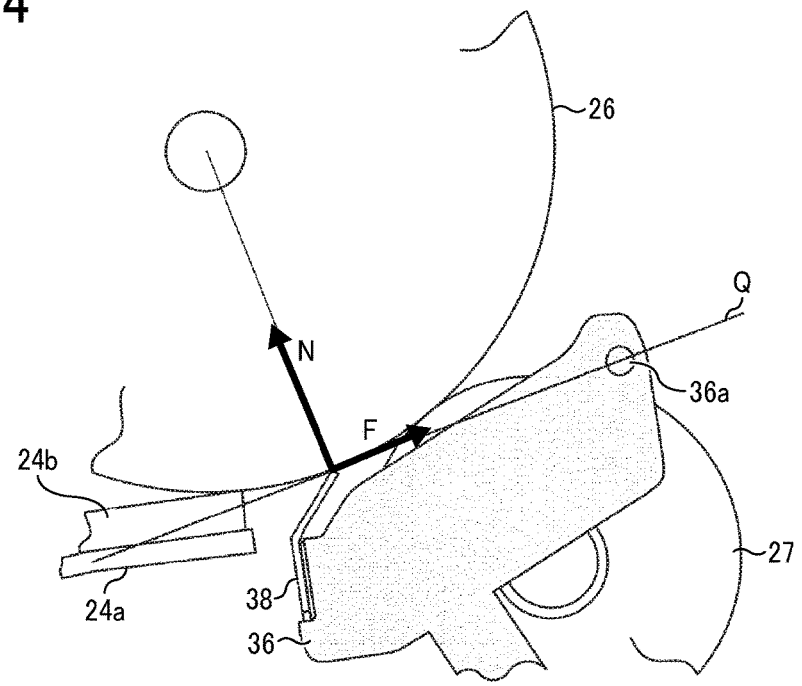
FIG. 24 is a schematic diagram illustrating a positional relation of the rotation shaft and the sheet separation nip region and a positional relation of the rotation shaft and the tangent line at the sheet separation nip region when a sheet is not entered, according to Embodiment 6 of this disclosure.

FIG. 24 illustrates a configuration of the sheet feeding device 6 according to Embodiment 6 of this disclosure. Specifically, FIG. 24 is a schematic diagram illustrating a positional relation of the support shaft 36*a* and the sheet separation nip region and a positional relation of the support shaft 36*a* and the tangent line Q at the sheet separation nip region when the sheet is not entered, according to Embodiment 6 of this disclosure.

In Embodiment 6, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26 and is disposed in the vicinity in the vertical direction of the tangent line Q that touches the contact position of the pressure plate 38 to the sheet feed roller 26. That is, the configuration of the sheet feeding device 6 in Embodiment 6 is basically identical to the configuration of the sheet feeding device 6 in Embodiment 1. Except that the position of the support shaft 36*a* is located downstream from the sheet separation nip region in the sheet conveying direction and in the vicinity in the vertical direction of the tangent line Q in Embodiment 6 is different from Embodiment 1.

Similar to Embodiment 3, the area in the vicinity of the tangent line Q in the vertical direction in Embodiment 6 corresponds to the range within the angle of ±20 degrees across the tangent line Q (see FIG. 19).

According to Embodiment 6 described above, similar to Embodiment 3, the pressure plate 38 is not set to the releasable setting (Embodiment 1) or the biting-in setting (Embodiment 2) with respect to the circumferential surface of the sheet feed roller 26. Therefore, a difference between the pressing load applied when the pressure plate 38 is directly in contact with the sheet feed roller 26 and the pressing load applied when the pressure plate 38 is directly in contact with the sheet P is small, and therefore the pressing load of the pressure plate 38 can obtain a constant pressing load with respect to the sheet feed roller 26.

According to Embodiment 6 described above, the position of the support shaft 36*a* that is the rotation fulcrum of the rotary body 36 is disposed downstream in the sheet conveying direction from the sheet separation nip region of the sheet P that is the contact position of the pressure plate 38 with the sheet feed roller 26. Therefore, when the sheet P enters the sheet separation nip region, the rotary body 36 rotates in the direction toward which the angle of the pressure plate 38 inclines to rise the pressure plate 38. Consequently, the multiple sheets P are prevented from being fed to the sheet separation nip region in a bundle of sheets, thereby reducing the probability of occurrence of multi-feed errors.

Further, according to Embodiment 6 described above, since the position of the support shaft 36*a* is located in the vicinity in the vertical direction of the tangent line Q that touches the contact position of the pressure plate 38 to the sheet feed roller 26, the pressure plate 38 is not set to the releasable setting or the biting-in setting with respect to the sheet feed roller 26. Therefore, the pressing load of the pressure plate 38 with respect to the sheet P becomes stable, and therefore it is easy to achieve the set pressing load. Accordingly, the operability of the image forming apparatus 1 can be enhanced and the probability of occurrence of paper jam can be reduced.

Figure 25:
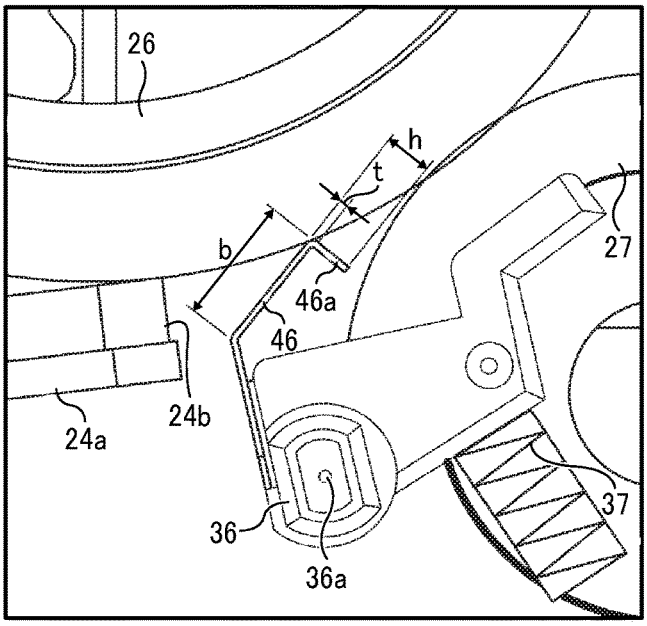
FIG. 25 is a schematic diagram illustrating a pressure plate according to Embodiment 7 of this disclosure.

FIG. 25 is a schematic diagram illustrating a pressure plate 46 that functions as a pressing member according to Embodiment 7 of this disclosure.

The structure of the pressure plate 46 of Embodiment 7 is basically identical to the pressure plate 38 of Embodiment 1, except that the pressure plate 46 includes a bent portion 46*a* at the leading end. The pressure plate 46 includes a stainless steel plate. The bent portion 46*a* is formed by bending the leading end of the pressure plate 46 at an angle of substantially 90 degrees toward a direction opposite to the sheet feed roller 26.

Now, respective moments of inertia in a loading direction at the leading end of the pressure plate 38 and the leading end of the pressure plate 46 are compared.

It is to be noted that "b" represents the base length of a metal plate, "h" represents the bending length of the metal plate, and "t" represents the thickness of the metal plate. In this case, the moment of inertia of the pressure plate 38 is expressed in the following equation: $I=(bt^3)/12$. By contrast, the moment of inertia of the pressure plate 46 is expressed in the following equation: $I'=(ht^3+3bt^3+3b^2t^2+b^3t)/12$. It is to be noted that, since the moment of inertia of a round leading end is very small, the value is set to 0. Where b=4.0 mm, h=1.5 mm, and t=0.2 mm, the moment of inertial I, which is the moment of inertia of the pressure plate 38, is 0.00267 $mm^4$ while the moment of inertial I', which is the moment of inertia of the pressure plate 46, is 1.2356 $mm^4$.

As described above, according to addition of the bent portion 46*a*, the moment of inertia increases, and therefore the stiffness of the metal plate also increases.

Figure 26:
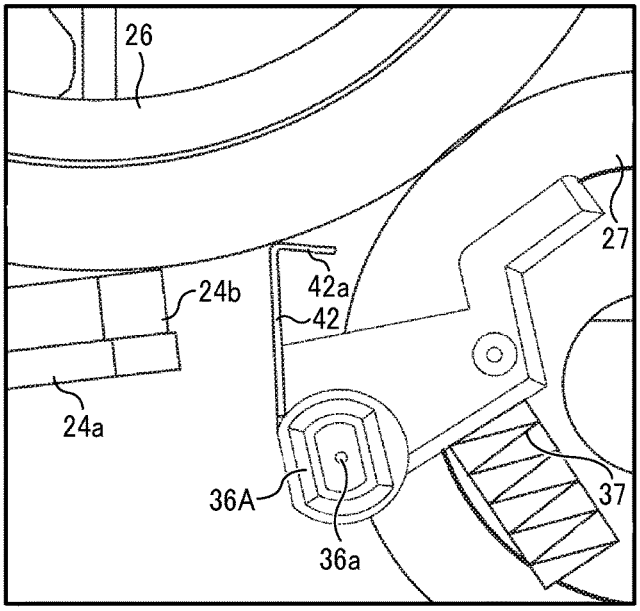
FIG. 26 is a schematic diagram illustrating a pressure plate according to Variation of Embodiment 7 of this disclosure.

FIG. 26 is a schematic diagram illustrating a pressure plate 42 and a rotary body 36A used in Variation of Embodiment 7 of this disclosure.

The pressure plate 42 includes a bent portion 42*a* and has a structure simpler than the pressure plate 46. Specifically, the rotary body 36A has a shape substantially identical to the rotary body 36 illustrated in FIG. 8, except that the rotary body 36A has a cut portion. Specifically, a part of the rotary body 36A is cut such that the bent portion 42*a* contacts an outer circumferential surface of the sheet feed roller 26 at a predetermined angle when the pressure plate 42 is attached to the rotary body 36A.

When compared with the pressure plate 38, the pressure plates 42 and 46 can enhance the stiffness and durability of the pressure plate. It is to be noted that, when compared with the pressure plate 46, the pressure plate 42 has a simpler structure, and therefore can achieve a reduction in cost. Further, when compared with the pressure plate 42, the pressure plate 46 includes a bent portion that starts to bend at a portion closer to a root thereof. Therefore, in a case in which the pressure plate 46 is attached to the rotary body 36 with adhesive such as tape, the pressure plate 46 does not come off from the rotary body 36 easily when the pressure plate 46 contacts the outer circumferential surface of the sheet feed roller 26.

Figure 27:
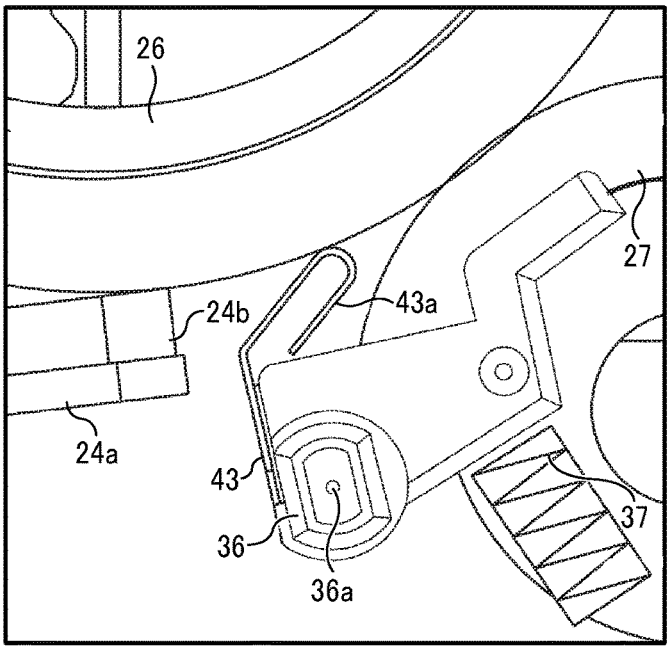
FIG. 27 is a schematic diagram illustrating a pressure plate according to Embodiment 8 of this disclosure.

FIG. 27 is a schematic diagram illustrating a pressure plate 43 that functions as a pressing member according to Embodiment 8 of this disclosure.

The pressure plate 43 includes a bent portion 43*a*. Specifically, the pressure plate 43 has a structure substantially identical to the pressure plate 46 illustrated in FIG. 25, except that the pressure plate 43 has a round (R) shape at the leading end.

Figure 28:
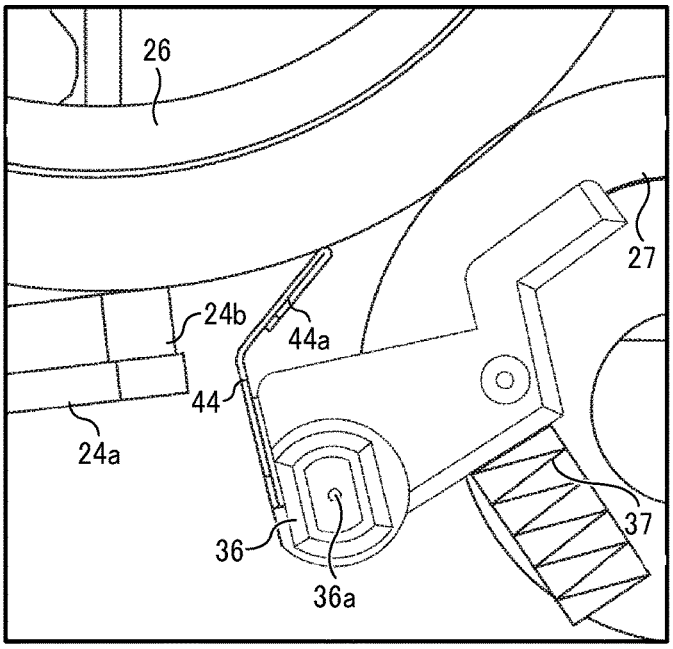
FIG. 28 is a schematic diagram illustrating a pressure plate according to Variation of Embodiment 8 of this disclosure.

Further, FIG. 28 is a schematic diagram illustrating a pressure plate 44 used in Variation of Embodiment 8 of this disclosure.

The pressure plate 44 includes a bent portion 44*a*. Specifically, the pressure plate 44 has a structure substantially identical to the pressure plate 43 illustrated in FIG. 27, except that the bent portion 44*a* of the pressure plate 44 is processed by a hemming operation. Since the bent portion 43*a* of the pressure plate 43 illustrated in FIG. 27 has the round leading end, the sheet P is less or not damaged when the pressure plate 43 contacts the sheet P. Since the bent portion 44*a* of the pressure plate 44 illustrated in FIG. 28 is not projected toward the sheet separation roller 27, a larger distance with respect to the sheet separation roller 27 can be obtained. According to this configuration, it is less likely that the pressure plates 43 and 44 contact the sheet separation roller 27, and therefore the configurations can prevent the sheet separation roller 27 from being damaged by the pressure plate.

Figure 29:
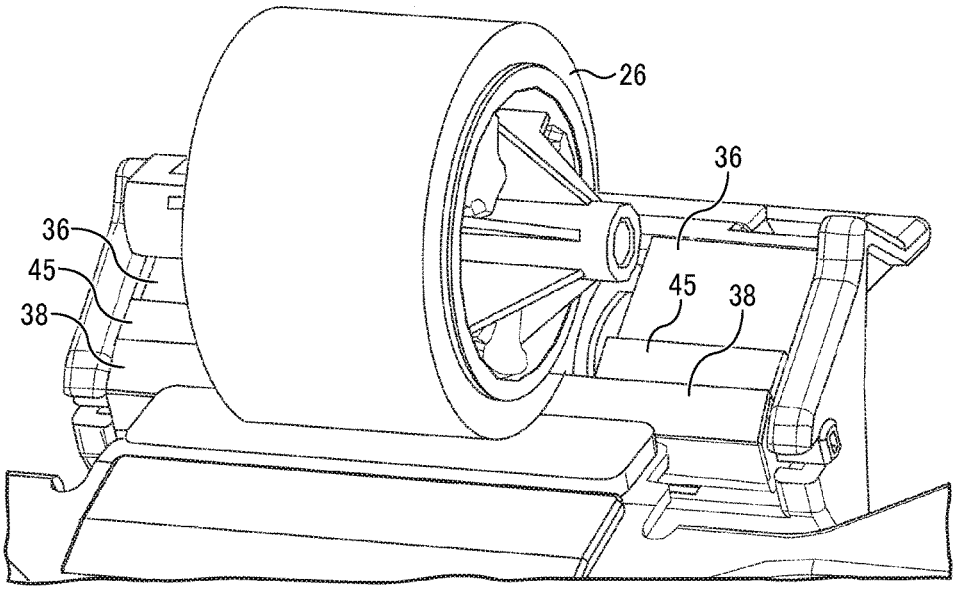
FIG. 29 is a schematic diagram illustrating friction members according to Embodiment 9 of this disclosure.

FIG. 29 illustrates a configuration of the sheet feeding device 6 according to Embodiment 9 of this disclosure. Specifically, FIG. 29 illustrates friction member 45 included in the sheet feeding device 6 according to Embodiment 9.

The sheet feeding device 6 of Embodiment 9 has a configuration basically identical to the sheet feeding device 6 of Embodiment 8. Except, in the configuration of Embodiment 9, the friction members 45 are disposed on the rotary body 36 on which the pressure plate 38 is mounted. Specifically, the friction members 45 are disposed on the rotary body 36 at both axial ends of the sheet feed roller 26 in respective areas where the friction members 45 do not contact the sheet feed roller 26 but contact the sheet P fed from the bottom plate 24*a*. In Embodiment 9, each of the friction members 45 has a rectangular parallelepiped shape and a material having high friction resistance with respect to the sheet P, for example, rubber and soft resin.

Figure 30:
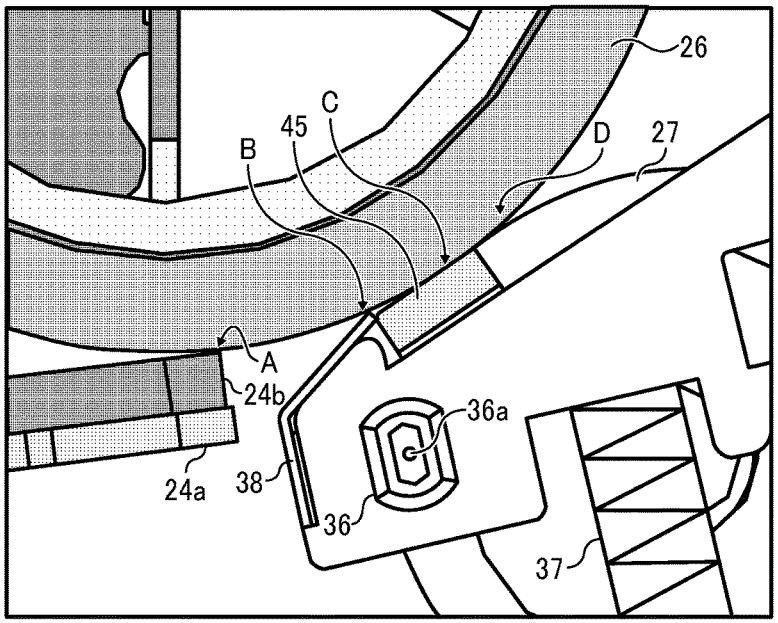
FIG. 30 is a schematic diagram illustrating a movement of a sheet in a configuration according to Embodiment 9 of this disclosure.

Next, a description is given of a movement of the sheet P at sheet feeding in the configuration according to Embodiment 9, with reference to FIG. 30. FIG. 30 is a schematic diagram illustrating the movement of the sheet P in Embodiment 9.

First, the sheet P loaded on the bottom plate 24*a* is pressed by the pad 24*b* against the circumferential surface of the sheet feed roller 26, as indicated by a first separation A in FIG. 30. Next, the sheet P is pressed by the leading end of the pressure plate 38 against the circumferential surface of the sheet feed roller 26, as indicated by a second separation B in FIG. 30. Then, the sheet P contacts the friction members 45 not on a first face that contacts the circumferential surface of the sheet feed roller 26 but on a second face that is opposite the first face of the sheet P, as indicated by a third separation C in FIG. 30. Finally, the sheet P is held between the sheet feed roller 26 and the sheet separation roller 27, as indicated by a fourth separation D in FIG. 30.

According to the above-described configuration, when compared with the configurations of Embodiments 1 through 8, the sheet feeding device 6 of Embodiment 9 having the friction members 45 that contact the second face of the sheet P can enhance the separation performance of the sheet P and can perform a good sheet separating and feeding operation. Further, even if multiple sheets P are fed from the sheet tray 24, the multiple sheets P are separated by the fourth separation D. Therefore, multi-feed error can be prevented, and therefore the good sheet separating and feeding operation can be performed continuously.

Figure 31:
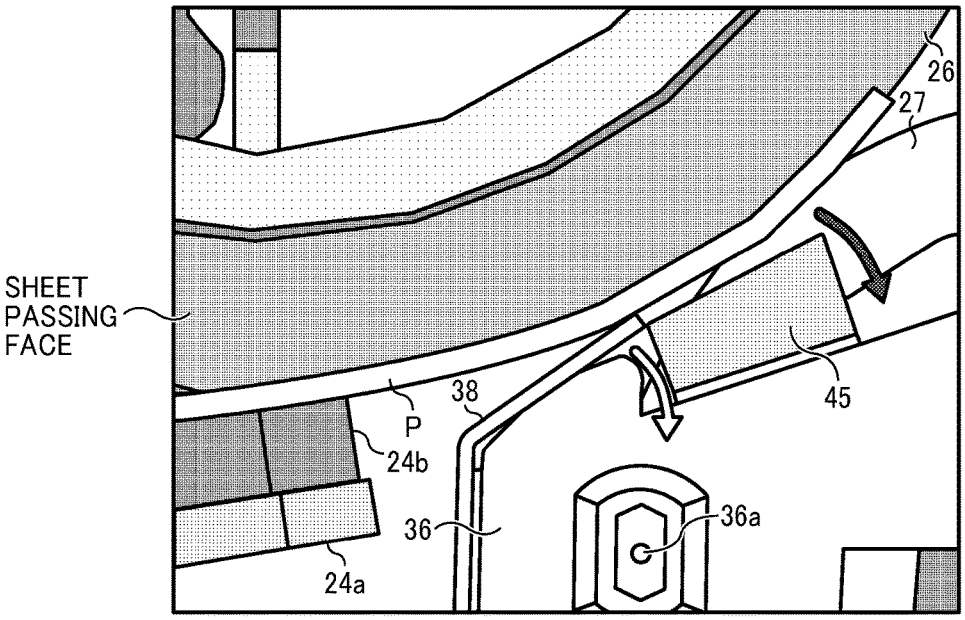
FIG. 31 is a schematic diagram illustrating displacement of a pressure plate and a friction member according to Embodiment 9 of this disclosure.

Further, in the above-described configuration of Embodiment 9, when the pressure plate 38 contacts the sheet P, the rotary body 36 rotates. Accordingly, the positions of the friction members 45 mounted on the rotary body 36 change toward a direction in which the friction members 45 separate from the sheet feed roller 26, as illustrated in FIG. 31. Therefore, it is prevented that the friction members 45 contact the sheet P at a position downstream from the pressure plate 38 in the sheet conveying direction. Accordingly, any leading end folds of the sheet P and damage on the sheet P generated due to contact of the friction members 45 with the sheet P can be prevented.

Figure 32:
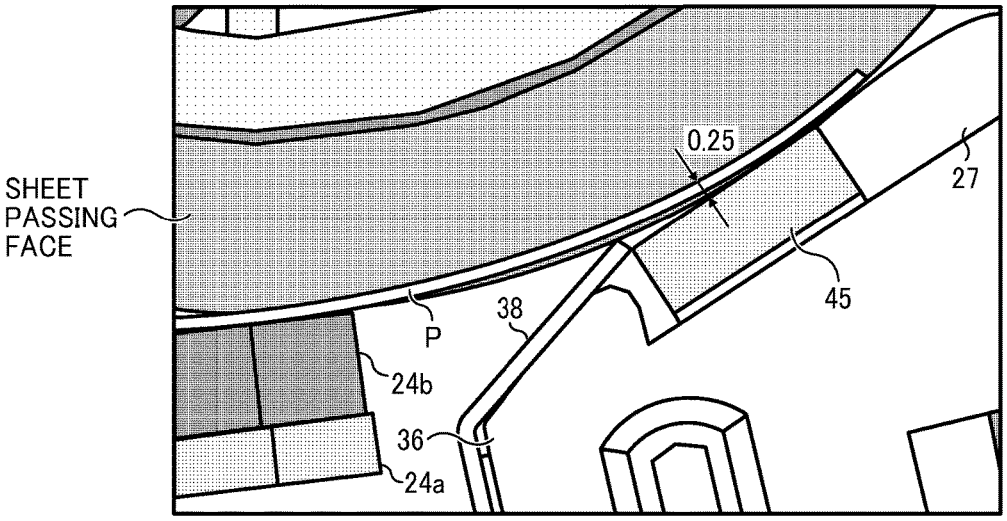
FIG. 32 is a schematic diagram illustrating a lowest position of the friction member according to Embodiment 9 of this disclosure.

As illustrated in FIG. 32, in Embodiment 9, the height of each of the friction members 45 on the side close to the pressure plate 38 is set to be lower than the height of the pressure plate 38 (for example, 0.25 mm in Embodiment 9). Further, the height of each of the friction members 45 on the side close to the sheet separation roller 27 is set to be the same as the height of an extension line of the circumferential surface (i.e., a sheet passing face) of the sheet feed roller 26. Accordingly, the sheet P that has passed by the pressure plate 38 as illustrated in FIG. 30 contacts the circumferential surface of the sheet feed roller 26 reliably, and therefore the separation performance can be enhanced.

Figure 33:
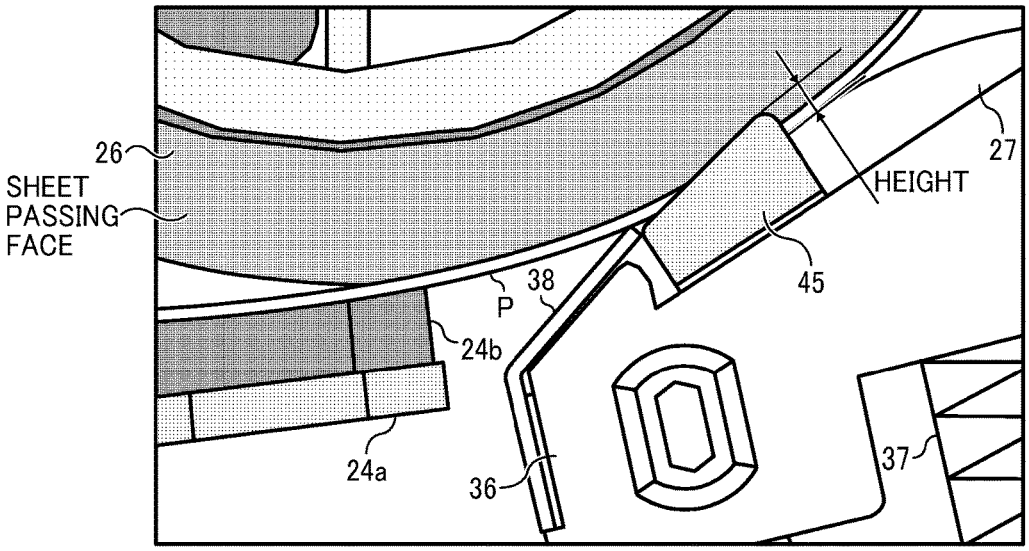
FIG. 33 is a schematic diagram illustrating a height of the friction member according to Embodiment 9 of this disclosure.

It is to be noted that the separation performance can be also enhanced by setting the height of each of the friction members 45 on the side to the sheet separation roller 27 to a biting-in side with respect to the sheet feed roller 26, as illustrated in FIG. 33. However, it is to be noted that a risk to damage the sheet P increases in proportion to the enhancement of separation performance.

Figure 34:
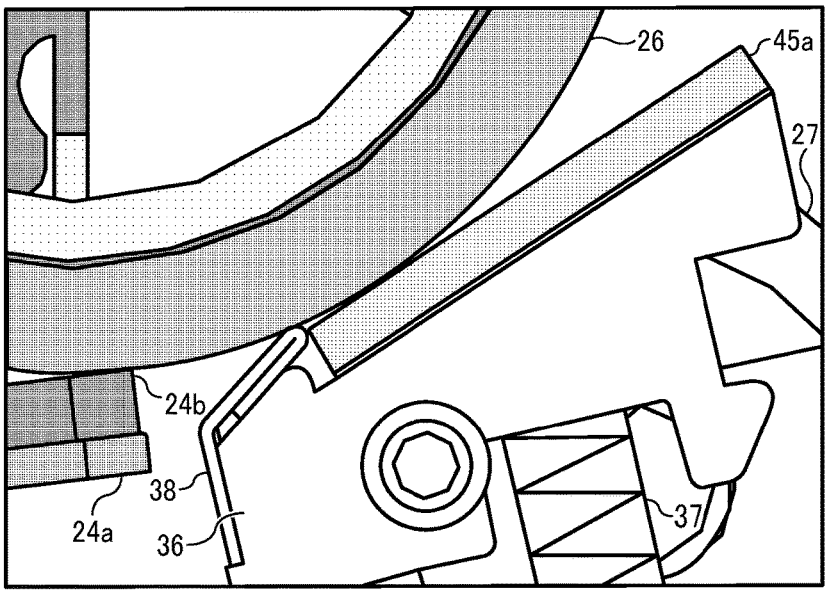
FIG. 34 is a schematic diagram illustrating a friction member according to Variation of Embodiment 9 of this disclosure.
Figure 35:
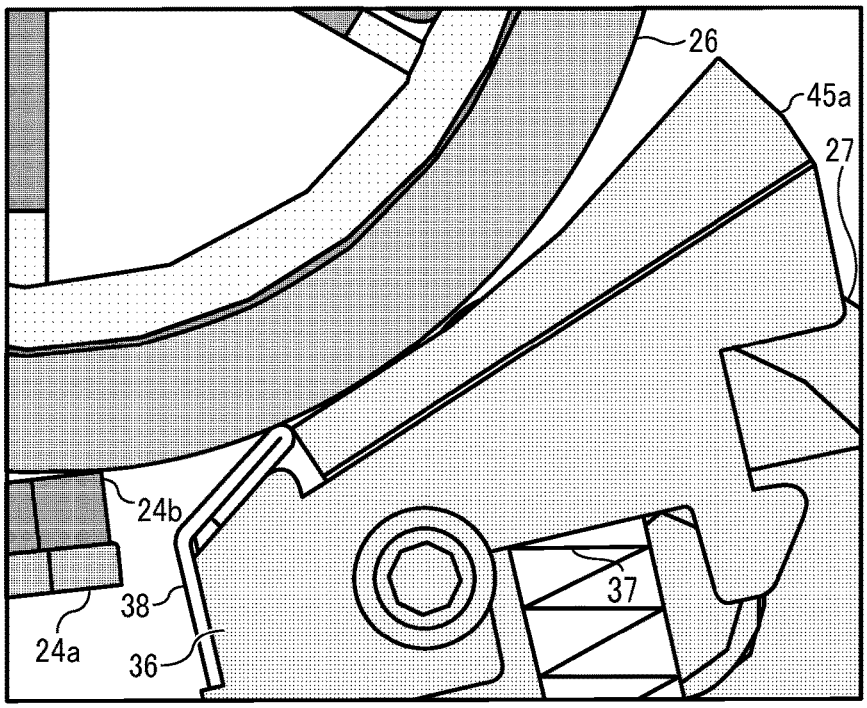
FIG. 35 is a schematic diagram illustrating a friction member according to another Variation of Embodiment 9 of this disclosure.

FIG. 34 is a schematic diagram illustrating a configuration of the sheet feeding device 6 according to Variation of Embodiment 9 of this disclosure. FIG. 35 is a schematic diagram illustrating a configuration of the sheet feeding device 6 according to another Variation of Embodiment 9 of this disclosure.

The configuration illustrated in FIG. 34 includes a friction member 45*a* instead of the friction members 45 and the configuration illustrated in FIG. 35 includes a friction member 45*b* instead of the friction members 45. Since the friction member 45*a* of FIG. 34 extends longer than each of the friction members 45 in the sheet conveying direction, the friction member 45*a* can increase a sheet separation range than the friction members 45, and therefore can enhance the separation performance. Similarly, since the friction member 45*b* of FIG. 35 extends longer than each of the friction members 45 in the sheet conveying direction and has an arc shape curving in the same center of circle as the sheet feed roller 26, the friction member 45*b* can further enhance the separation performance than the friction member 45*a*.

In each of the above-described Embodiments 1 through 9, a metal sheet such as a stainless sheet is employed to the pressure plates 38, 42, 43, 44, and 46. According to this configuration, the pressure plate has a good contact durability with the sheet P. Therefore, the image forming apparatus 1 has less deformation and wear, requires no maintenance, has a long service life, and less charging error on a sheet feeding member and a recording medium, thereby reducing an adverse effect to an image. In addition, the image forming apparatus 1 employs a resin plate instead of a metal plate. Therefore, the sliding ability is enhanced to restrain a load on a sheet feeding member and a recording medium, thereby reducing wear of the sheet feeding member and damage to the recording medium.

Figure 36:
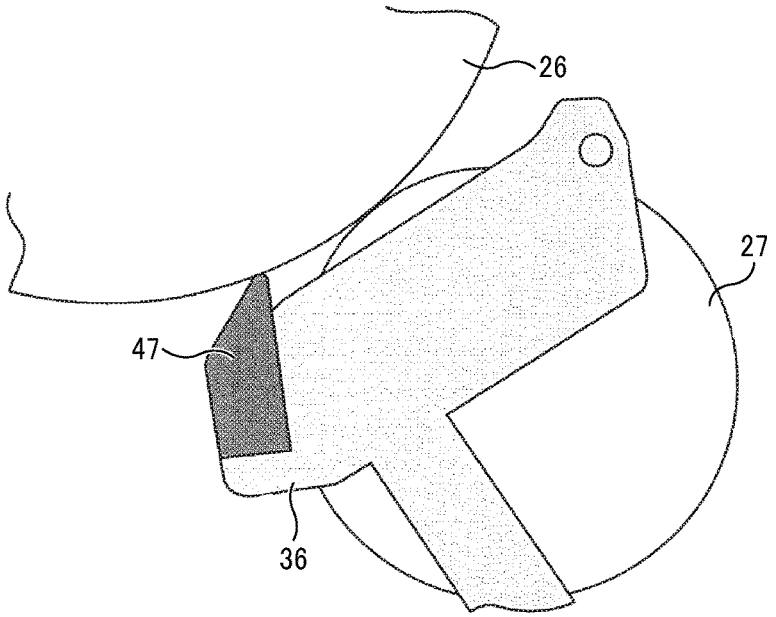
FIG. 36 is a schematic diagram illustrating a pressing member according to Variation of each embodiment of this disclosure.

As an example of a pressing member, a pressure plate 47 can be applied, as illustrated in FIG. 36. For example, the pressure plate 47 is formed by working a massive metal material such as a sintered material. By employing the pressure plate 47, the sheet feeding device 6 can enhance a degree of freedom in shape of a contact portion and a pressing portion with a sheet and an attaching portion to a rotary body, and therefore can enhance a degree of freedom in design.

Figure 37:
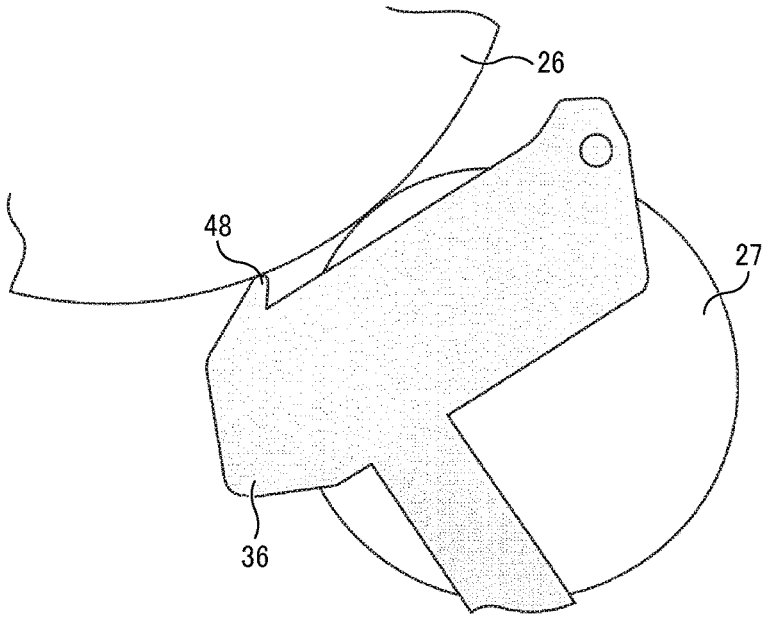
FIG. 37 is a schematic diagram illustrating a pressing member according to another Variation of each embodiment of this disclosure.

As another example of a pressing member, a pressure plate 48 can be applied, as illustrated in FIG. 37. For example, the pressure plate 48 is formed as a single unit with the rotary body 36. By employing the pressure plate 48, an accumulation of a dimensional tolerance in the separation nip region can be restrained and, at the same time, a parts cost and a manufacturing cost can be reduced.

Further, in each of the above-described Embodiments 1 through 9, the pair of left and right rotary bodies 36 is disposed at both ends in the axial direction of the sheet separation roller 27 and the respective compression springs 37 bias the pair of left and right rotary bodies 36.

Accordingly, clearance or gap inside the sheet feeding device 6 and the image forming apparatus 1 can be used effectively, which promotes space saving. At the same time, the compression springs 37 disposed at both ends in the axial direction of the sheet separation roller 27 can bias the pressure plate 38 in a balanced manner. As a result, the sheet can be well separated.

Figure 38:
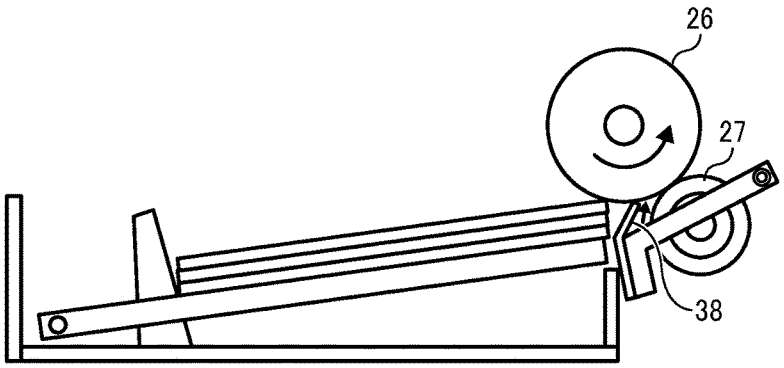
FIG. 38 is a schematic diagram illustrating a sheet feeder according to an embodiment of this disclosure.
Figure 39:
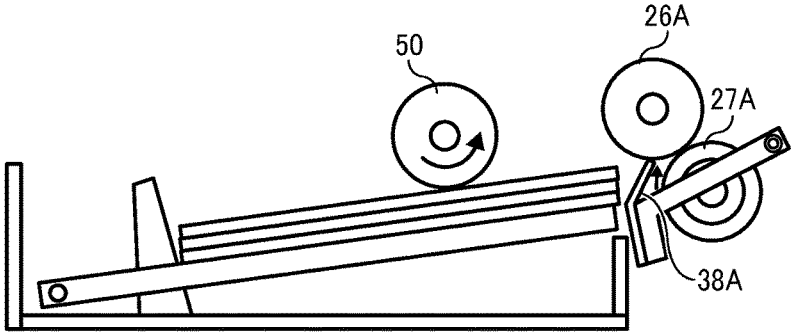
FIG. 39 is a schematic diagram illustrating a sheet feeder of this disclosure.
Figure 40:
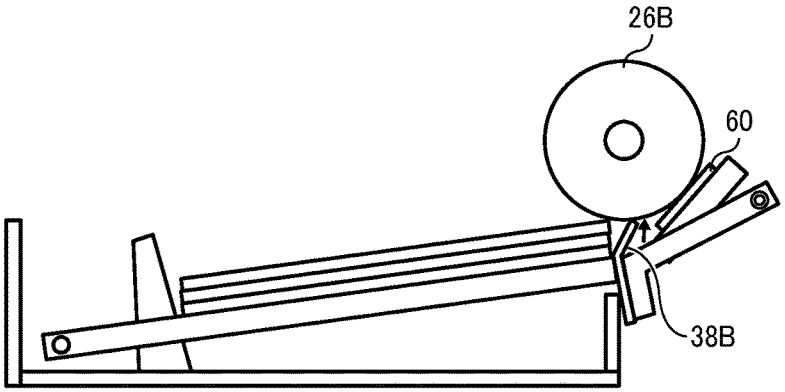
FIG. 40 is a schematic diagram illustrating another sheet feeder of this disclosure.

In the above-described Embodiments 1 through 9, a sheet feeder according to this disclosure corresponds to the sheet feeding device 6 that includes a sheet feed roller, a sheet separation roller, and a pressing member, as illustrated in FIG. 38. However, the sheet feeder that is applicable to this disclosure is not limited thereto. For example, a configuration that includes a pickup roller, a sheet feed roller, a separation roller, and a pressing member as illustrated in FIG. 39, a configuration that includes a sheet feed roller, a friction pad, and a pressing member, and any other sheet feeder can be applied to this disclosure.

As previously described, in the above-described Embodiments 1 through 9, the sheet P is employed as a recording medium on which an image is formed. However, the sheet P is not limited thereto but also includes thick paper, postcard, envelope, plain paper, thin paper, coated paper, art paper, tracing paper, and the like. The sheet P further includes a non-paper material such as OHP sheet, OHP film, resin film, and any other sheet-shaped material on which an image can be formed.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

a sheet feeding unit configured to feed a sheet;

a sheet separating unit opposite the sheet feeding unit configured to separate the sheet together with the sheet feeding unit;

a bottom plate configured to have the sheet loaded thereon;

a pressure plate having a leading end, the pressure plate is movably disposed between the bottom plate and the sheet separating unit; and a support configured to rotatably support the pressure plate such that the leading end of the pressure plate contacts and separates from the sheet feeding unit.

2. The sheet feeder according to claim 1, wherein, the support is configured to support the pressure plate at a support position the pressure plate is configured to contact the sheet feeding unit at a contact position, and the support position is located upstream from the contact position in a sheet conveying direction.

3. The sheet feeder according to claim 2, wherein, in a vertical direction, the support position is located at an upper side from a tangent line at the contact position.

4. The sheet feeder according to claim 2, wherein, in a vertical direction, the support position is located at a lower side from a tangent line at the contact position.

5. The sheet feeder according to claim 2, wherein, in a vertical direction, the support position is located near a tangent line at the contact position.

6. The sheet feeder according to claim 2, wherein, in a vertical direction, the support position is located at a lower side from a tangent line at the contact position.

7. The sheet feeder according to claim 2, wherein, in a vertical direction, the support position is located near a tangent line at the contact position.

8. The sheet feeder according to claim 1, wherein the support is configured to support the pressure plate at a support position the pressure plate is configured to contact the sheet feeding unit at a contact position, and the support position is located downstream from the contact position in a sheet conveying direction.

9. The sheet feeder according to claim 8, wherein the support position is located at an upper side from a tangent line in a vertical direction.

10. The sheet feeder according to claim 1, wherein an axial width of the pressure plate is greater than an axial width of the sheet feeding unit.

11. The sheet feeder according to claim 1, further comprising:

a rotary body; and a biasing unit mounted on the support, wherein, the support is configured to rotatably support the rotary body, and the leading end of the pressure plate is configured to contact the sheet feeding unit by attaching the pressure plate to the rotary body and biasing the rotary body by the biasing unit.

12. The sheet feeder according to claim 11, wherein the pressure plate and the rotary body are formed in a single unit.

13. The sheet feeder according to claim 12, wherein the biasing unit is disposed at both axial ends of the sheet separating unit.

14. The sheet feeder according to claim 11, wherein the biasing unit is disposed at both axial ends of the sheet separating unit.

15. The sheet feeder according to claim 11, further comprising a friction unit attached to the rotary body and disposed at both axial ends of the sheet feeding unit, wherein the friction unit is configured to contact the sheet at a position between a contact position where the pressure plate is configured to contact the sheet feeding unit via the sheet and a contact position where the sheet separating unit is configured to contact the sheet feeding unit via the sheet.

16. The sheet feeder according to claim 15, wherein the friction unit has a height beyond an extension line on a contact face of the sheet feeding unit with the pressure plate when the pressure plate contacts the sheet feeding unit.

17. The sheet feeder according to claim 15, wherein, the sheet feeding unit and the friction unit are configured to contact, separate, and feed the sheet after the sheet conveyed from the bottom plate is pressed by the pressure plate against the sheet feeding unit.

18. The sheet feeder according to claim 1, wherein the sheet separating unit includes a torque limiter.

19. An image forming apparatus comprising:

an image forming device to form an image on a sheet; and the sheet feeder according to claim 1 configured to convey the sheet toward the image forming device.

20. A sheet feeder comprising:

a sheet feeding roller configured to feed a sheet;

a sheet separating roller opposite the sheet feeding roller configured to separate the sheet together with the sheet feeding roller;

a bottom plate configured to have the sheet loaded thereon;

a pressure plate having a leading end, the pressure plate is movably disposed between the bottom plate and the sheet separating unit; and a support shaft configured to rotatably support the pressure plate such that the leading end of the pressure plate contacts and separates from the sheet feeding roller.

* * * * *